US008366424B2

(12) United States Patent
Furusho et al.

(10) Patent No.: US 8,366,424 B2
(45) Date of Patent: Feb. 5, 2013

(54) ROTARY FLUID MACHINE WITH REVERSE MOMENT GENERATING MECHANISM

(75) Inventors: Kazuhiro Furusho, Sakai (JP); Takashi Shimizu, Sakai (JP); Masanori Masuda, Sakai (JP); Yoshitaka Shibamoto, Sakai (JP); Takazo Sotojima, Sakai (JP); Kenichi Sata, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 927 days.

(21) Appl. No.: 12/447,224

(22) PCT Filed: Oct. 17, 2007

(86) PCT No.: PCT/JP2007/070252

§ 371 (c)(1),
(2), (4) Date: Apr. 24, 2009

(87) PCT Pub. No.: WO2008/053708

PCT Pub. Date: May 8, 2008

(65) Prior Publication Data

US 2010/0092322 A1 Apr. 15, 2010

(30) Foreign Application Priority Data

Oct. 27, 2006 (JP) ..... 2006-293014
Feb. 28, 2007 (JP) ..... 2007-049313

(51) Int. Cl.

| | |
|---|---|
| ***F01C 1/02*** | (2006.01) |
| ***F01C 1/063*** | (2006.01) |
| ***F01C 1/00*** | (2006.01) |
| ***F04C 2/00*** | (2006.01) |
| ***F04C 18/00*** | (2006.01) |

(52) U.S. Cl. ..... 418/55.1; 418/161; 418/243

(58) Field of Classification Search ..... 418/55.1, 418/55.3, 59, 161, 204, 210

See application file for complete search history.

(56) References Cited

U.S. PATENT DOCUMENTS

| | | | | |
|---|---|---|---|---|
| 4,606,711 | A | 8/1986 | Mitsui et al. | |
| 4,609,334 | A | 9/1986 | Muir et al. | |
| 5,562,436 | A * | 10/1996 | Kawahara et al. | 418/55.5 |
| 6,379,134 | B2 * | 4/2002 | Iizuka | 418/55.3 |
| 7,766,633 | B2 * | 8/2010 | Nakamura et al. | 418/55.1 |
| 8,157,553 | B2 * | 4/2012 | Yamazaki et al. | 418/55.1 |
| 2003/0147763 | A1 * | 8/2003 | Sakuda et al. | 418/55.1 |
| 2008/0095652 | A1 * | 4/2008 | Jiang | 418/48 |

(Continued)

FOREIGN PATENT DOCUMENTS

| | | |
|---|---|---|
| EP | 0 085 248 A1 | 8/1983 |
| JP | 58-107887 A | 6/1983 |

(Continued)

*Primary Examiner* — Mary A Davis

(74) *Attorney, Agent, or Firm* — Global IP Counselors

(57) ABSTRACT

A rotary fluid machinery includes a fixed member, a drive shaft driven and rotated about a rotation axis, a movable member, a movable member support part and a reverse moment generating mechanism. The movable member is rotatably mounted at the drive shaft with its center being eccentrically disposed relative to the rotation axis, with the movable member and the fixed member forming a fluid chamber. Revolution of the movable member changes the volume of the fluid chamber. The movable member is configured to swing in association with its revolution. The reverse moment generating mechanism generates a moment in a reverse direction about the rotation axis relative to a moment about the rotation axis caused by the revolving movement of the movable member.

15 Claims, 17 Drawing Sheets

U.S. PATENT DOCUMENTS

| | | | | |
|---|---|---|---|---|
| 2008/0145253 | A1 | 6/2008 | Uekawa | |
| 2009/0123315 | A1 * | 5/2009 | Nakamura et al. ..... | 418/55.1 |

FOREIGN PATENT DOCUMENTS

| | | | |
|---|---|---|---|
| JP | 59-128991 | A | 7/1984 |
| JP | 59-131702 | A | 7/1984 |
| JP | 59-145385 | A | 8/1984 |
| JP | 61-57952 | B | 12/1986 |
| JP | 03-15618 | A | 7/1991 |
| JP | 05-81721 | B | 11/1993 |
| JP | 2005-330962 | A | 12/2005 |
| JP | 2006-200528 | A | 8/2006 |
| JP | 2006-242195 | A | 9/2006 |
| WO | WO 2006067844 | A1 * | 6/2006 |

* cited by examiner (A) 0° : 180°

(C) 180° : 0°

(B) 90° : 270°

(D) 270° : 90°

ROTARY FLUID MACHINE WITH REVERSE MOMENT GENERATING MECHANISM

CROSS-REFERENCE TO RELATED APPLICATIONS

This U.S. National stage application claims priority under 35 U.S.C. §119(a) to Japanese Patent Application Nos. 2006-293014, filed in Japan on Oct. 27, 2006, and 2007-049313, filed in Japan on Feb. 28, 2007, the entire contents of which are hereby incorporated herein by reference.

TECHNICAL FIELD

The present invention relates to a rotary fluid machinery including a fixed member and a movable member forming a fluid chamber together with the fixed member.

BACKGROUND ART

Conventionally, rotary fluid machineries have been known which include a fixed member and a movable member forming a fluid chamber together with the fixed member.

For example, a rotary fluid machinery disclosed in Japanese Unexamined Patent Application Publication 2005-330962 is so configured that a cylinder (a movable member) including an annular cylinder chamber, and an annular piston (a fixed member) arranged in the cylinder chamber are in relative revolution. In this rotary fluid machinery, the annular cylinder chamber is formed between an inside cylinder and an outside cylinder forming the cylinder. This cylinder chamber is defined into inside and outside cylinder chambers by the annular piston. Further, the outside and inside cylinder chambers are defined by a blade provided at the cylinder into a high pressure chamber and a low pressure chamber. The blade is fitted in a blade groove of a swing bush (a movable member support part) swingably supported by the annular piston. The cylinder thus supported by the blade and the swing bush moves back and forth relative to the swing bush while swinging about the swing bush in its revolution.

In the fluid machinery, when the cylinder is in the revolution relative to the annular piston, fluid is sucked to the low pressure chambers in the cylinder chambers, is compressed, and is then discharged from the high pressure chambers.

SUMMARY OF THE INVENTION

Problems that the Invention is to Solve

In a configuration in which the cylinder swings about the swing bush as a center as above, the cylinder rotates so that the blade is directed at the center of the swing bush. The speed and direction of the rotation of the cylinder change in association with the revolution of the cylinder, in other words, the swing motion of the cylinder. At the cylinder, this generates moment (hereinafter also referred to as rotation moment) caused by the rotation. Since the rotation of the cylinder is limited by the swing bush as described above, the reaction force against the rotation moment of the cylinder acts on the swing bush. This reaction force acts on the entire rotary fluid machinery as moment (hereinafter it may be refereed to as moment caused by the reaction force) about the center of gravity of the fluid machinery (usually, the drive shaft) to serve as vibration force vibrating the rotary fluid machinery. On the drive shaft to which the cylinder is eccentrically mounted, a load by the rotation moment of the cylinder acts, thereby generating moment (hereinafter it may be referred to as moment caused by the load) about the drive shaft. Though the moment caused by the reaction force is dominant, the moment caused by the load also acts about the drive shaft as vibration force vibrating the rotary fluid machinery. Hereinafter, a combination of the moment caused by the reaction force and the moment caused by the load may be referred to as moment caused by the rotation.

The present invention has been made in view of the foregoing, and its objective is to suppress, in a rotary fluid machinery in which a movable member revolves relative a fixed member while swinging in association with its rotation, vibration caused by the rotation of the movable member.

Means for Solving the Problems

As described above, it had been found that the moment caused by the rotation of the movable member serves as the additional vibrating force vibrating the rotary fluid machinery, and accordingly, the present invention attempted to cancel the moment caused by the rotation of the movable member by generating moment in the reverse direction to that of the moment caused by the rotation of the movable member.

Specifically, a first aspect of the present invention is directed to a rotary fluid machinery which includes a fixed member (22), a drive shaft (33) driven and rotated about a predetermined rotation axis (X), and a movable member (21) rotatably mounted at the drive shaft (33) with its center being eccentric and forming a fluid chamber (C1, C2) together with the fixed member (22), and which changes a volume of the fluid chamber (C1, C2) by revolution of the movable member (21). The rotary fluid machinery further includes: a movable member support part (23, 27) having one part engaging with the movable member (21) to limit rotation of the movable member (21) in the revolution; and a reverse moment generating mechanism (50) configured to generate moment in a reverse direction to moment about the rotation axis (X) caused by the rotation of the movable member (21).

In the above configuration, although the rotation of the movable member (21) is limited by the movable member support part (23, 27), the movable member (21) revolves while rotating within the predetermined range. Therefore, the rotation speed and direction of the movable member (21) change according to the revolution. Accordingly, the rotation moment is generated at the movable member (21) according to the change in rotation speed and direction. The rotation of the movable member (21) is limited by the movable member support part (23, 27) to allow the reaction force against the rotation moment to act on the movable member support part (23, 27), thereby generating the moment caused by the reaction force in the rotary fluid machinery. Further, a load by the rotation moment of the movable member (21) acts on the drive shaft (33) at which the movable member (21) is mounted to generate the moment caused by the load at the drive shaft (33). Hence, the moment caused by the rotation of the movable member (21) acts on the rotary fluid machinery about the rotation axis (X).

However, in the present invention, the reverse moment generating mechanism (50) generates moment about the rotation axis (X) of the drive shaft (33) in the reverse direction to that of the moment caused by the rotation of the movable member (21), so that the moments cancel each other to reduce the moment acting on the drive shaft (33) about the rotation axis (X). As a result, vibration of the rotary fluid machinery can be suppressed. Herein, the term "cancellation" and its variants mean cancellation which is not required to completely cancel moment and is sufficient if the total amount of the moments can be reduced.

Referring to a second aspect of the present invention, the movable member support part (23, 27) supports the movable member (21) swingably and movably in a back and forth direction on a plane where the movable member (21) revolves, thereby allowing the revolution of the movable member (21) while limiting the rotation thereof, the reverse moment generating mechanism (50) includes a revolution body (51) rotatably mounted at the drive shaft (33) with its center being eccentric, and a revolution body support part (53, 54) supporting the revolution body (51) swingably and movably in a back and forth direction on a plane where the revolution body (51) revolves, thereby allowing the revolution of the revolution body (51) while limiting rotation thereof, the revolution body (51) is eccentric on an opposite side of the rotation axis (X) to the movable member (21), and the revolution body support part (53, 54) is arranged at a same angular position about the rotation axis (X) as the movable member support part (23, 27).

In the above configuration, the movable member support part (23, 27) supports the movable member (21) movably in a back and forth direction and swingably, so that during the rotation of the drive shaft (33) about the rotation axis (X), the movable member (21) freely moves back and forth relative to the movable member support part (23, 27) in a plane on which the movable member (21) revolves, while swinging about the movable member support part (23, 27) as a center. That is, the movable member (21) rotates within the range where it swings about the movable member support part (23, 27) (or, the rotation thereof is limited).

The direction of this swing motion changes twice within one revolution of the movable member (21). Specifically, when the movable member (21) revolves about the rotation axis (X) from a point where it is aligned with the movable member support part (23, 27) on the straight line radially extending from the rotation axis (X) in a plan view, the movable member (21) swings about the movable member support part (23, 27) as a center in one direction corresponding to the eccentric direction. When the revolution angle is substantially 90 degrees, the swing angle is maximum. When the movable member (21) further revolves from this point, the swing direction of the movable member (21) is switched, and the movable member (21) starts swinging in the other direction. When the revolution angle is substantially 270 degrees, the swing angle is maximum on the other direction side. When the movable member (21) further revolves from this point, the swing direction of the movable member (21) is switched, and the movable member (21) starts swinging in the one direction again. The movable member (21) returns to the point where it is aligned with the movable member support part (23, 27) on the straight line radially extending from the rotation axis (X) in a plan view.

During this time, the movable member (21) rotates in accordance with its swing motion. That is, the rotation speed of the movable member (21) changes when the swing speed thereof changes, and the rotation direction thereof is switched when the swing direction thereof is switched. In this way, change in rotation speed and switching of the rotation direction of the movable member (21) generate rotation moment about its axis at the movable member (21).

The rotation of the movable member (21) is limited by the movable member support part (23, 27) for its swing motion, with a result that the reaction force against the rotation moment of the movable member (21) acts on the movable member support part (23, 27). By this reaction force, moment caused by the reaction force is generated in the rotary fluid machinery. This moment caused by the reaction force serves as vibration force vibrating the rotary fluid machinery.

Further, the movable member (21) is mounted at the drive shaft (33), and therefore, a load by the rotation moment acts on the drive shaft (33). As a result, this load by the rotation moment generates moment caused by the load at the drive shaft (33). This moment caused by the load also serves as vibration force vibrating the rotary fluid machinery.

On the other hand, the revolution body (51) of the reverse moment generating mechanism (50) is rotatably mounted at the drive shaft (33) with its center being eccentric, and is supported movably in a back and forth direction and swingably by the revolution body support part (53, 54), so that the revolution body (51) revolves about the rotation axis (X) of the drive shaft (33), while freely moving in the back and forth direction relative to the revolution body support part (53, 54) and swinging about the revolution body support part (53, 54) as a center, similarly to the movable member (21). When the revolution body (51) revolves by substantially 90 degrees or 270 degrees about the rotation axis (X) from a point where it is aligned with the revolution body support part (53, 54) on the straight line radially extending from the rotation axis (X) in a plan view, its swing direction is switched.

The revolution body (51) is eccentric on the opposite side of the rotation axis (X) of the drive shaft (33) to the movable member (21), so that the revolution body (51) revolves with its phase shifted by 180 degrees relative to that of the movable member (21). The revolution body support part (53, 54) is arranged at the same angular position about the rotation axis (X) as the movable member support part (23, 27). Hence, the revolution body (51) swings with its phase shifted by 180 degrees relative to that of the movable member (21).

As a result, when the rotation direction of the movable member (21) is switched to the counterclockwise direction from the clockwise direction, the rotation direction of the revolution body (51) is switched at almost the same timing to the clockwise direction from the counterclockwise direction. Also, when the rotation direction of the movable member (21) is switched to the clockwise direction from the counterclockwise direction, the rotation direction of the revolution body (51) is switched at almost the same timing to the counterclockwise direction from the clockwise direction. In other words, during the time when the movable member (21) rotates clockwise, the revolution body (51) rotates counterclockwise. In reverse, during the time when the movable member (21) rotates counterclockwise, the revolution body (51) rotates clockwise. The rotation of the revolution body (51) in the revere direction to that of the movable member (21) can generate the rotation moment in the reverse direction to that of the rotation moment of the movable member (21) at the revolution body (51), and can cause the moment caused by the reaction force and the moment caused by the load of the revolution body (51), which is in the reverse direction to that of the moment caused by the reaction force and moment caused by the load of the movable member (21), to act about the rotation axis (X) of the drive shaft (33). This reduces the moment caused by the rotation of the movable member (21) acting about the rotation axis (X) of the drive shaft (33), thereby suppressing vibration of the rotary fluid machinery.

Referring to a third aspect of the present invention, the movable member support part (23, 27) supports the movable member (222) swingably and movably in a back and forth direction on a plane where the movable member (222) revolves, thereby allowing the revolution of the movable member (222) while limiting the rotation thereof, the reverse moment generating mechanism (250) includes a revolution body (251) rotatably mounted at the drive shaft (233) with its center being eccentric, and a revolution body support part (253, 254) supporting the revolution body (251) swingably and movably in a back and forth direction on a plane where the revolution body (251) revolves, thereby allowing the revolution of the revolution body (251) while limiting the rotation thereof, the revolution body (251) is eccentric on a same side of the rotation axis (X) as the movable member (222), and the revolution body support part (253, 254) is arranged at an angular position shifted by 180 degrees about the rotation axis (X) from the movable member support part (23, 27).

In the above configuration, similarly to the second aspect, the movable member (222) revolves about the rotation axis (X) of the drive shaft, while freely moving in the back and forth direction relative to the movable member support part (23, 27) on the plane where the movable member (222) revolves and swinging about the movable member support part (23, 27) as a center. The swing direction of the movable member (222) is switched when the movable member (222) revolves by substantially 90 degrees or substantially 270 degrees about the rotation axis (X) from the point when it is aligned with the movable member support part (23, 27) on the straight line radially extending from the rotation axis (X) in a plan view. That is, the rotation direction of the movable member (222) is different between when its revolution angle is from 0 degree to substantially 90 degrees, or from substantially 270 degrees to 0 degree, and when it is from substantially 90 degrees to substantially 270 degrees.

On the other hand, the revolution body (251) of the reverse moment generating mechanism (250) revolves about the rotation axis (X) of the drive shaft, while freely moving in the back and forth direction relative to the revolution body support part (253, 254) and swinging about the revolution body support part (253, 254) as a center, similarly to the movable member (222). In this time, similarly to the movable member (222), the swing direction of the revolution body (251) is switched, when the revolution body (251) revolves by substantially 90 degrees or substantially 270 degrees about the rotation axis (X) from the point where it is aligned with the revolution body support part (253, 254) on the straight line radially extending from the rotation axis (X) in a plan view. In other words, the rotation direction of the revolution body (251) is different between when its revolution angle is between 0 degree and substantially 90 degrees, or between substantially 270 degrees and 0 degree, and when it is between substantially 90 degrees and substantially 270 degrees, similarly to the movable member (222).

Herein, the movable member (222) and the revolution body (251) are eccentric on the same side of the rotation axis (X) of the drive shaft (or, are aligned on the straight line radially extending from the rotation axis (X)), so that the movable member (222) and the revolution body (251) revolve with their angular positions about the rotation axis (X) agreeing with each other (or, consistently aligned on the straight line radially extending from the rotation axis (X)).

Provision of the movable member support part (23, 27) and the revolution body support part (253, 254) at points shifted by 180 degrees about the rotation axis (X) relative to each other means that the revolution angle of the movable member (222) is shifted by substantially 180 degrees from that of the revolution body (251) with reference to the respective support parts of the movable member (222) and the revolution body (251). That is, when the movable member (222) revolves by substantially 90 degrees from the point where it is aligned with the movable member support part (23, 27) on the straight line radially extending from the rotation axis (X) in a plan view, the revolution body (251) revolves by substantially 270 degrees from the point where it is aligned with the revolution body support part (253, 254) on the straight line radially extending from the rotation axis (X) in a plan view. Also, when the movable member (222) revolves by substantially 270 degrees from the point where it is aligned with the movable member support part (23, 27) on the straight line radially extending from the rotation axis (X) in a plan view, the revolution body (251) revolves by substantially 90 degrees from the point where it is aligned with the revolution body support part (253, 254) on the straight line radially extending from the rotation axis (X) in a plan view.

As a result, when the rotation direction of the movable member (222) is switched to the counterclockwise direction from the clockwise direction, the rotation direction of the revolution body (251) is switched at almost the same timing to the clockwise direction from the counterclockwise direction. Also, when the rotation direction of the movable member (222) is switched to the clockwise direction from the counterclockwise direction, the rotation direction of the revolution body (251) is switched at almost the same timing to the counterclockwise direction from the clockwise direction. In other words, during the time when the movable member (222) rotates clockwise, the revolution body (251) rotates counterclockwise. In reverse, during the time when the movable member (222) rotates counterclockwise, the revolution body (251) rotates clockwise. The rotation of the revolution body (251) in the revere direction to that of the movable member (222) can generate the rotation moment in the reverse direction to that of the rotation moment of the movable member (222) at the revolution body (251), and can cause the moment caused by the reaction force and the moment caused by the load of the revolution body (251), which are in the reverse direction to that of the moment caused by the reaction force and moment caused by the load of the movable member (222), to act about the rotation axis (X) of the drive shaft (233). This reduces the moment caused by the rotation of the movable member (222) acting about the rotation axis (X) of the drive shaft (233), thereby suppressing vibration of the rotary fluid machinery.

Referring to a fourth aspect of the present invention, the revolution body support part (53, 54) includes a pin (53) provided at the revolution body (51), and a guide part (54) fixed to the fixed member (22) and slidably and rotatably supporting the pin (53).

In the above configuration, the revolution body (51) can swing about the pin (53) as a swing center. In swinging, the revolution body (51) rotates within a range where it swings. The pin (53) can slide along the guide part (54) to freely move in the back and forth direction. That is, since the swing center of the revolution body (51) can freely move in the back and forth direction along the guide part (54), the revolution body (51) can revolves about the rotation axis (X) of the drive shaft (33) as a center while swinging about the pin (53) as a center with its rotation limited.

Referring to a fifth aspect of the present invention, the revolution body support part (353, 354) includes a pin (535) fixed to the fixed member (322), and a guide part (354) provided at the revolution body (351), the guide part (354) being rotatable and slidable relative to support the pin (353).

In the above configuration, the revolution body (351) can swing about the pin (353) as a swing center. In swinging, the revolution body (351) rotates within a range where it swings. The revolution body (351) can freely move in the back and forth direction relative to the pin (353) through the guide part (354). In other words, the revolution body (351) can swing with the distance from the pin (353) as a swing center freely changed, and therefore, the revolution body (351) can revolves about the rotation axis (X) of the drive shaft while swinging about the pin (353) as a center with its rotation limited.

Referring to a sixth aspect of the present invention, the revolution body (51) is made of a material having a specific gravity larger than that of the movable member (21).

In the above configuration, the amount of the moment caused by the rotation of the revolution body (51), which acts about the rotation axis (X) of the drive shaft (33) by the rotation of the revolution body (51), changes according to the weight of the revolution body (51), the distance between the rotation axis (X) and the center of gravity of the revolution body (51), and the like, and is determined by to-be-cancelled moment caused by the rotation of the movable member (21). That is, the weight of the revolution body (51) is determined by the moment caused by the rotation of the revolution body (51) and the like. In the above configuration, the revolution body (51) is made of a material having a specific gravity larger than that of the movable member (21) to reduce the size of the revolution body (51) relative to a desired weight of the revolution body (51), thereby reducing the space that the revolution body (51) occupies.

Referring to a seventh aspect of the present invention, the fixed member is a cylinder (321), the fluid chamber is a cylinder chamber (C) formed in the cylinder (321), the movable member is a piston (322) accommodated in the cylinder chamber (C) with its center being eccentric with respect to the cylinder (321), and the movable member support part (323, 27) includes a blade (323) provided at the piston (322) and defining the cylinder chamber (C) into a high pressure chamber (C-Hp) and a low pressure chamber (C-Lp), and a swing bush (27) swingably supported by the cylinder (321) and supporting the blade (323) movably in a back and forth direction.

In the above configuration, the piston (322) as a movable member is supported by the blade (323) provided at the piston (322) and the swing bush (27) provided at the cylinder (321) to be movable in the back and forth direction and swingable, and therefore, the piston (322) can swing in association with its rotation while revolving in the cylinder chamber (C).

Referring to an eighth aspect of the present invention, the rotary fluid machinery further includes a cylinder (21) including an annular cylinder chamber (C1, C2); and an annular piston (22) accommodated in the cylinder chamber (C1, C2) with its center being eccentric with respect to the cylinder (21) to define the cylinder chamber (C1, C2) into an outside cylinder chamber (C1) and an inside cylinder chamber (C2), wherein one of the cylinder (21) and the annular piston (22) is the fixed member, while the other is the movable member, the fluid chambers (C1, C2) are the outside and inside cylinder chambers (C1, C2), and the movable member support part (23, 27) includes a blade (23) provided at the cylinder (21) and defining the outside and inside cylinder chambers (C1, C2) into high pressure chambers (C1-Hp, C2-Hp) and low pressure chambers (C1-Lp, C2-Lp), and the swing bush (27) swingably supported by the annular piston (22) and supporting the blade (23) movably in a back and forth direction.

In the above configuration, one of the cylinder (21) and the annular piston (22) which serves as a movable member is supported by the blade (23) provided at the cylinder (21) and the swing bush (27) provided at the piston (21), to be revolveble and swingable in association with its rotation.

Referring to a ninth aspect of the present invention, the fixed member is a fixed scroll (460), and the movable member is an orbiting scroll (470) engaging with the fixed scroll (460) to form the fluid chamber (C).

The above configuration is directed to a scroll type rotary fluid machinery instead of the rotary fluid machinery of piston-cylinder type in the seventh or eighth aspect.

Advantages

According to the present invention, the reverse moment generating mechanism (50) for generating moment about the rotation axis (X) in the reverse direction to that of the moment caused by the rotation of the movable member (21) is provided to cancel the moment caused by the rotation of the movable member (21) about the rotation axis (X), thereby suppressing vibration of the rotary fluid machinery.

In the second aspect of the present invention, the revolution body (51) is eccentric on the opposite side of the rotation axis (X) to the movable member (21), and the revolution body support part (53, 54) is arranged at the same angular position about the rotation axis (X) as the movable member support part (23, 27). Accordingly, the movable member (21) and the revolution body (51) both mounted at the drive shaft (33) are allowed to rotate in the reverse directions to each other, with a result that the moment caused by the rotation of the movable member (21) and the moment caused by the rotation of the revolution body (51) can act in the reverse directions to each other to cancel each other, thereby suppressing vibration of the rotary fluid machinery.

In the third aspect of the present invention, the revolution body (251) is eccentric on the same side of the rotation axis (X) as the movable member (222), and the revolution body support part (253, 254) is arranged at an angular position shifted by 180 degrees about the rotation axis (X) from the movable member support part (23, 27). Accordingly, the movable member (222) and the revolution body (251) both mounted at the drive shaft can rotate in the reverse directions to each other, with a result that the moment caused by the rotation of the movable member (222) and the moment caused by the rotation of the revolution body (251) can act in the reverse directions to each other to cancel each other, thereby suppressing vibration of the rotary fluid machinery.

In the fourth aspect of the present invention, the revolution body support part (53, 54) includes the pin (53) provided at the revolution body (51), and the guide part (54) provided at and fixed to the fixed member (22), so that the swing center can freely move in the back and forth direction along the guide part (54), and the revolution body (51) can revolve about the rotation axis (X) of the drive shaft (33) while swinging about the pin (53) as a center with its rotation limited.

In the fifth aspect of the present invention, the revolution body support part (353, 354) includes the pin (53) provided at and fixed to the fixed member (322), and the guide part (54) provided at the revolution body, so that the distance between the revolution body and the pin (535) as the swing center can be changed freely, and the revolution body can revolve about the rotation axis (X) of the drive shaft while swinging about the pin (53) as a center with its rotation limited.

In the sixth aspect of the present invention, the revolution body (51) is made of a material having a specific gravity larger than the movable member (21). This can reduce the size of the revolution body (51) relative to a desired weight of the revolution body (51), thereby reducing the space that the revolution body (51) occupies.

According to the seventh aspect of the present invention, in the rotary fluid machinery in which the piston (322) is supported by the cylinder (321) for its revolution with its rotation limited by the blade (323) and the swing bush (27), the moment caused by the rotation of the piston (322) can be reduced to suppress vibration of the rotary fluid machinery.

According to the eighth aspect of the present invention, in the rotary fluid machinery in which one of the cylinder (21) including the annular cylinder chamber (C1, C2) and the annular piston (22) is supported by the blade (23) and the swing bush (27) for its revolution with its rotation limited, the moment caused by the rotation of the cylinder (21) or the annular piston (22) can be reduced to suppress vibration of the rotary fluid machinery.

According to the ninth aspect of the present invention, in the scroll type rotary fluid machinery including the fixed scroll (460) and the orbiting scroll (470), the moment caused by the rotation of the orbiting scroll (470) can be reduced to suppress vibration of the rotary fluid machinery.

DETAILED DESCRIPTION OF THE INVENTION

Example embodiments of the present invention will be described below with reference to the accompanying drawings.

Example Embodiment 1

Figure 1:
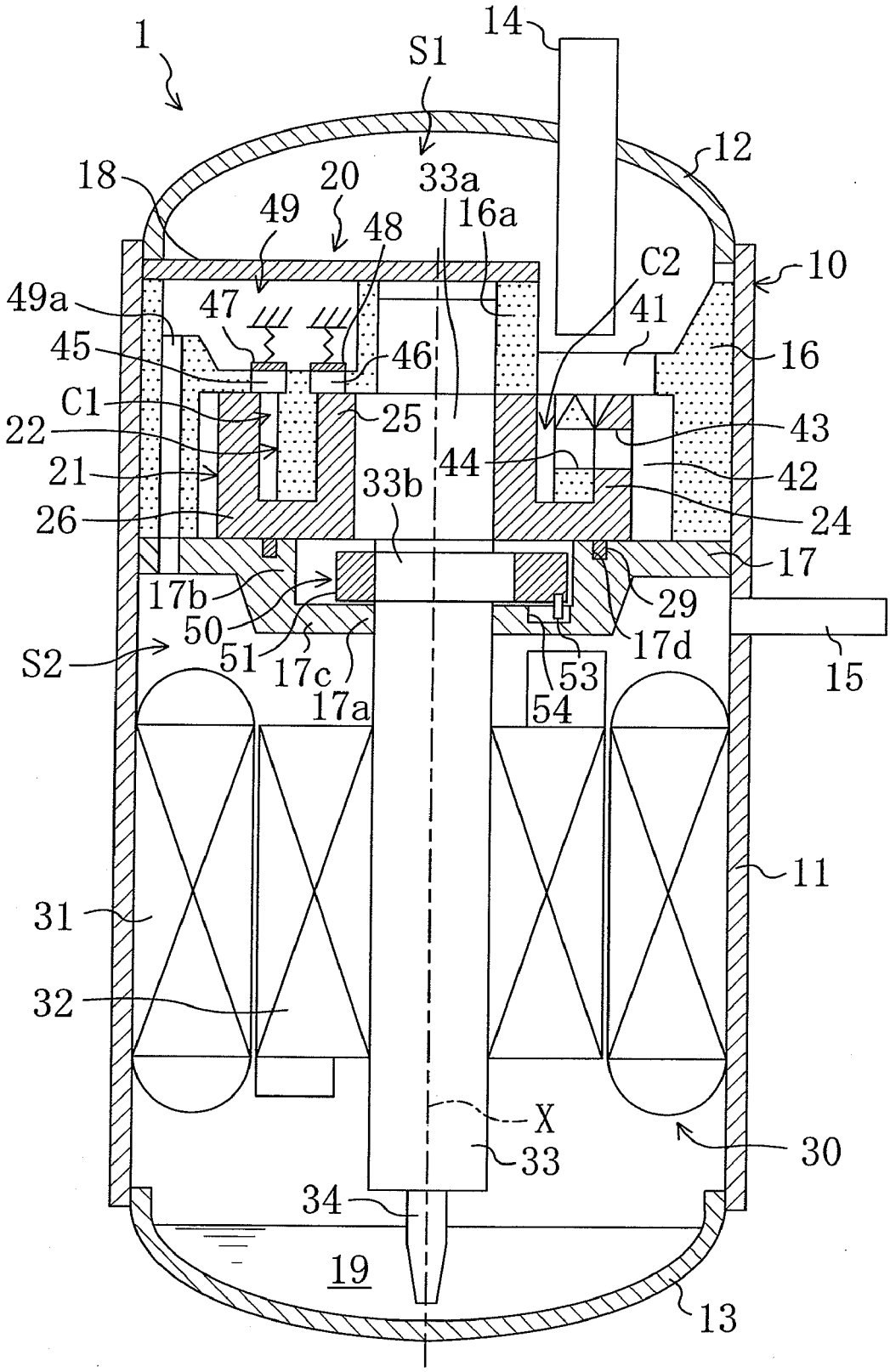
FIG. 1 is a vertical cross-section of a compressor in accordance with Example Embodiment 1 of the present invention.

As shown in FIG. 1, a rotary compressor (1) in the present example embodiment is of hermetic type, in which a compression mechanism (20) and a motor (30) are accommodated in a casing (10). The compressor (1) is used for compressing refrigerant sucked from an evaporator and discharging it to a condenser in a refrigerant circuit of, for example, an air conditioner.

The casing (10) includes a cylindrical body part (11), an upper head (12) fixed to the upper end of the body part (11), and a lower head (13) fixed to the lower end of the body part (11). A suction pipe (14) is provided to pass through the upper head (12), while a discharge pipe (15) is provided to pass through the body part (11).

Figure 2:
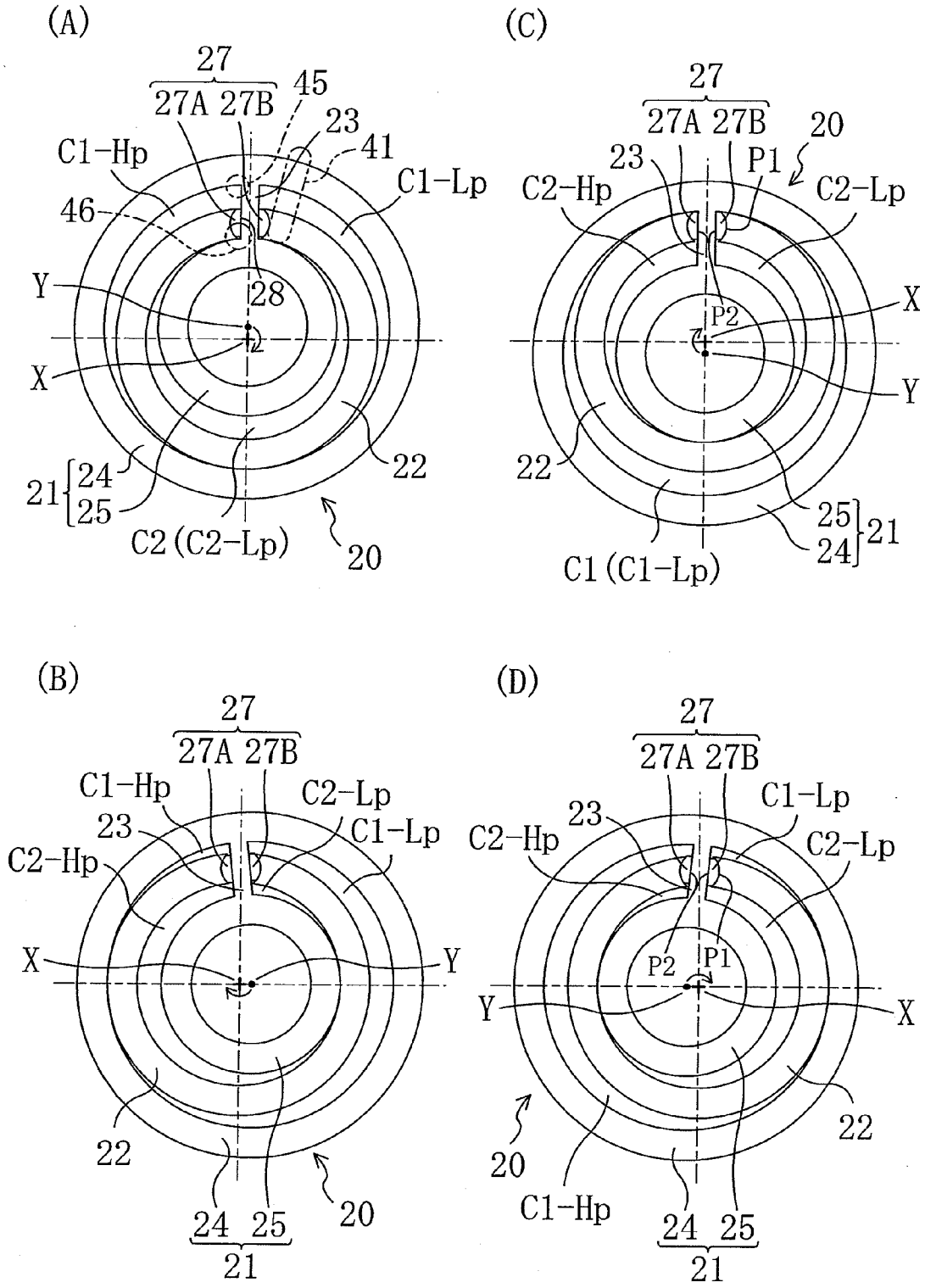
FIG. 2 illustrates schematic explanatory drawings showing an operation of a compression mechanism.

The compression mechanism (20) is disposed between an upper housing (16) and a lower housing (17) fixed to the casing (10). The compression mechanism (20) includes a cylinder (21) having a cylinder chamber (C1, C2) annular in section across its axis at a right angle, an annular piston (22) arranged in the cylinder chamber (C1, C2), and a blade (23) defining, as shown in FIG. 2, the cylinder chamber (C1, C2) into high pressure chambers (compression chambers) (C1-Hp, C2-Hp) and low pressure chambers (suction chambers) (C1-Lp, C2-Lp). The cylinder (21) and the annular piston (22) are configured to perform relative eccentric turn. In Example Embodiment 1, the cylinder (21) including the cylinder chamber (C1, C2) serves as a movable member, while the annular piston (22) disposed in the cylinder chamber (C1, C2) serves as a fixed member.

The motor (30) includes a stator (31) and a rotor (32). The stator (31) is disposed below the compression mechanism (20), and is fixed to the body part (11) of the casing (10). A drive shaft (33) is connected to the rotor (32), and is configured to rotate together with the rotor (32) about a rotation axis (X). The drive shaft (33) vertically passes through the cylinder chamber (C1, C2).

The drive shaft (33) includes a first eccentric part (33*a*) formed at a part corresponding to the annular piston (22), and a second eccentric part (33*b*) formed below the first eccentric part (33*a*). The diameters of the first and second eccentric parts (33*a*, 33*b*) are larger than those of parts above and below the first and second eccentric parts (33*a*, 33*b*), and the first and second eccentric parts (33*a*, 33*b*) are eccentric by predetermined amounts on the opposite sides of the rotation axis (X) to each other.

Further, an oil supply path (not shown) is provided to axially extend inside the drive shaft (33). An oil supply pump (34) is provided at the lower end of the drive shaft (33). The oil supply path extends from the oil supply pump (34) upward to the compression mechanism (20). With this configuration, the oil supply pump (34) supplies lubricant oil retained in an oil retainer (19) in a high pressure space (S2), which will be described later, in the casing (10) to the sliding parts of the compression mechanism (20) through the oil supply path.

A bearing (16*a*) is provided at the central part of the upper housing (16) for supporting the drive shaft (33). On the other hand, a downwardly recessed recess (17*b*) is formed in the central part of the lower housing (17). A bearing (17*a*) is formed to pass through the central part of the bottom (17*c*) of the recess (17*b*) for supporting the drive shaft (33). Thus, the compressor (1) in the present example embodiment is in an axis passing structure in which the drive shaft (33) passes vertically through the cylinder chamber (C1, C2), and parts located on respective one sides in the axial direction of the first and second eccentric parts (33*a*, 33*b*) are held to the casing (10) through the bearings (16*a*, 17*a*). It is noted that the second eccentric part (33*b*) is located inside the recess (17*b*) of the lower housing (17). The upper housing (16), the lower housing (17), and the annular piston (22), which will be described later in detail, are made of cast iron or the like.

The cylinder (21) includes a cylindrical outside cylinder (24) and a cylindrical inside cylinder (25). The inner peripheral surface of the outside cylinder (24) and the outer peripheral surface of the inside cylinder (25) are cylindrical and coaxial surfaces, and the cylinder chamber (C1, C2) is formed therebetween. The outside cylinder (24) and the inside cylinder (25) are connected to each other at their lower ends by an end plate (26) to be integrated with each other. The inside cylinder (25) is slidably fitted to the first eccentric part (33*a*) of the drive shaft (33). The cylinder (21) is made of an aluminum alloy or the like, for example.

The blade (23) extends, as shown in FIG. 2, in the radial direction of the cylinder chamber (C1, C2) from the wall surface on the inner peripheral side of the cylinder chamber (C1, C2) (the outer peripheral surface of the inside cylinder (25)) to the wall surface on the outer peripheral side thereof (the inner peripheral surface of the outside cylinder (24)), and is fixed to the outside cylinder (24) and the inside cylinder (25). The blade (23) may be formed integrally with the outside cylinder (24) and the inside cylinder (25). Alternatively, another member may be integrated with the cylinders (24, 25).

The annular piston (22) is in a cylindrical shape, and is formed integrally with the upper housing (16). The annular piston (22) has an outer peripheral surface having a diameter smaller than that of the inner peripheral surface of the outside cylinder (24), and an inner peripheral surface having a diameter larger than that of the outer peripheral surface of the inside cylinder (25). The annular piston (22) is disposed inside the cylinder chamber (C1, C2) of the cylinder (21). In the state that the outer peripheral surface of the annular piston (22) is substantially in contact at one point with the inner peripheral surface of the outside cylinder (24) (strictly, a gap in the order of microns is present there, but involves no problem in refrigerant leakage therethrough), the inner peripheral surface of the annular piston (22) is in contact with the outer peripheral surface of the inside cylinder (25) at one point where its phase is shifted by 180 degrees from that of the one contact point. In this way, the outside cylinder chamber (C1) is formed between the outer peripheral surface of the annular piston (22) and the inner peripheral surface of the outside cylinder (24), while the inside cylinder chamber (C2) is formed between the inner peripheral surface of the annular piston (22) and the outer peripheral surface of the inside cylinder (25).

The annular piston (22) is formed in a C-shape that is a ring shape which is cut. A swing bush (27) is disposed at the cut part as a joining member for movably joining the annular piston (22) and the blade (23). The swing bush (27) includes a discharge side bush (27A) located on the side of the high pressure chamber (C1-Hp, C2-Hp) with respect to the blade (23), and a suction side bush (27B) located on the side of the low pressure chamber (C1-*hp*, C2-Hp) with respect to the blade (23). The discharge side bush (27A) and the suction side bush (27B) are formed substantially in the same semicircular shape in section, and disposed so that the flat surfaces thereof are opposed to each other. A space between the opposed faces of the bushes (27A, 27B) forms a blade groove (28).

The blade (23) is inserted in the blade groove (28). The flat faces (second sliding surfaces (P2): see FIG. 2(C)) of the swing bushes (27A, 27B) are substantially in face contact with the blade (23), while the arc-shaped outer peripheral surfaces (first sliding surfaces (P1)) thereof are substantially in face contact with the annular piston (22). The swing bushes (27A, 27B) are configured to allow the blade (23) to move back and forth in its in-plane direction in the blade groove (28) with the blade (23) inserted in the blade groove (28). Further, the swing bushes (27A, 27B) are configured to swing integrally with the blade (23) relative to the annular piston (22). Accordingly, the swing bush (27) allows the blade (23) and the annular piston (22) to swing relatively to each other about the center of the swing bush (27) as a swing center, and to allow the blade (23) to move in the back and forth direction in the in-plane direction of the blade (23) relative to the annular piston (22). The blade (23) and the swing bush (27) serve as a movable member support part.

In the present example embodiment, the bushes (27A, 27B) are separated from each other, but the bushes (27A, 28B) may be in an integral form at a part of which they are connected to each other.

In the above configuration, when the drive shaft (33) rotates, the outside cylinder (24) and the inside cylinder (25) revolve about the rotation axis (X), and the blade (23) moves in the back and forth direction in the blade groove (28) while swinging about the center of the swing bush (27) as a swing center. This swing motion moves the contact points between the annular piston (22) and the cylinder (21) from FIG. 2(A) through to FIG. 2(D) sequentially.

In the upper housing (16), a suction port (41) is formed below the suction pipe (14). The suction port (41) is in a long hole shape extending from the inside cylinder chamber (C2) to a suction space (42) formed around the outside cylinder (24). The suction port (41) passes through the upper housing (16) in its axial direction to allow the low pressure chambers (C1-Hp, C2-Lp) of the cylinder chamber (C1, C2) and the suction space (42) to communicate with a space (a low pressure space S1)) above the upper housing (16). In the outer cylinder (24), a through hole (43) is formed to allow the suction space (42) to communicate with the low pressure chamber (C1-Lp) of the outside cylinder chamber (C1). In the annular piston (22), a through hole (44) is formed to allow the low pressure chamber (C1-Lp) of the outside cylinder chamber (C1) to communicate with the low pressure chamber (C2-Lp) of the inside cylinder chamber (C2).

The upper end parts of the outside cylinder (24) and the annular piston (22) which correspond to the suction port (41) are chamfered to be in a wedge shape. This can achieve efficient refrigerant suction to the low pressure chambers (C1-Lp, C2-Lp).

Discharge ports (42, 46) are formed in the upper housing (46). The discharge ports (45, 46) passes through the upper housing (16) in its axial direction. The lower end of the discharge port (45) opens to the high pressure chamber (C1-Lp) of the outside cylinder chamber (C1), while the lower end of discharge port (46) opens to the high pressure chamber (C2-Hp) of the inside cylinder chamber (C2). On the other hand, the upper ends of the discharge ports (45, 46) communicate with the discharge space (49) through discharge valves (reed valves) (47, 48) opening/closing the discharge ports (45, 46).

The discharge space (49) is formed between the upper housing (16) and a cover plate (18). In the upper housing (16) and the lower housing (17), a discharge path (49*a*) is formed to allow the discharge space (49) to communicate with the space (the high pressure space (S2)) below the lower housing (17).

On the other hand, a seal ring (29) is provided in the lower housing (17). The seal ring (29) is fitted in an annular groove (17*d*) of the lower housing (17) to be in pressure contact with the lower surface of the end plate (26) of the cylinder (21). High pressure lubricant oil is introduced in a part of the contact face between the cylinder (21) and the lower housing (17) which is inside in the radial direction of the seal ring (29). Accordingly, the seal ring (29) serves as a compliance mechanism utilizing the pressure of the lubricant oil to reduce the gap in the axial direction between the lower end surface of the annular piston (22) and the end plate (26) of the cylinder (21).

In the recess (17*b*) of the lower housing (17), a reverse moment generating mechanism (50) is disposed. The reverse moment generating mechanism (50) includes a revolution body (51) provided at the second eccentric part (33*b*) of the drive shaft (33), and a slide groove (54) supporting the revolution body (51).

Figure 3:
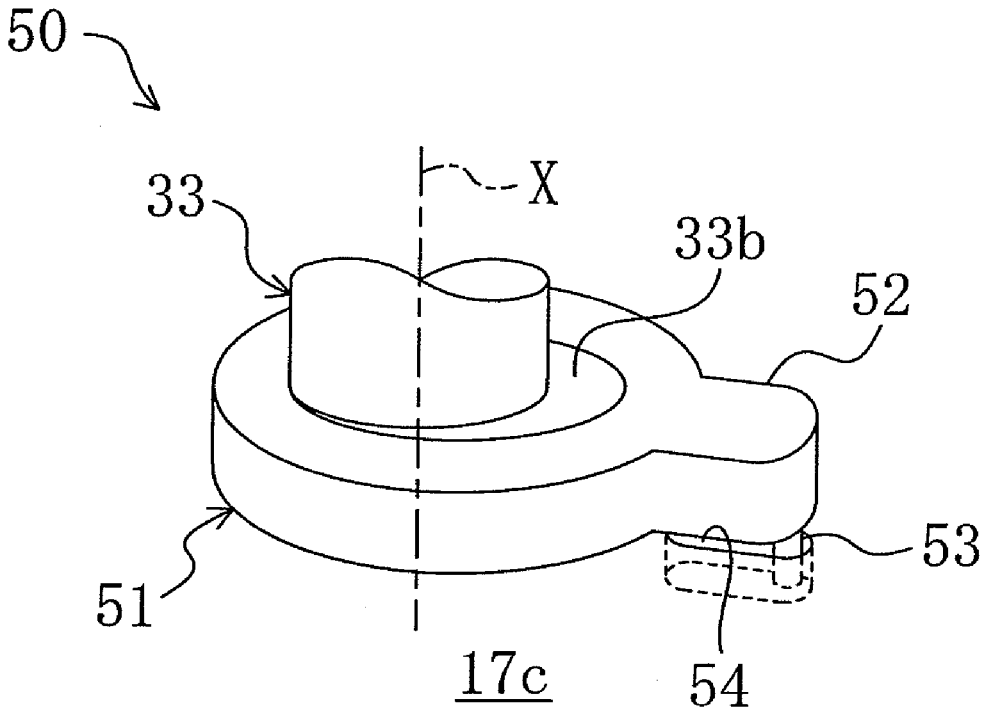
FIG. 3 is a perspective view showing a configuration of a reverse moment generating mechanism.
Figure 4:
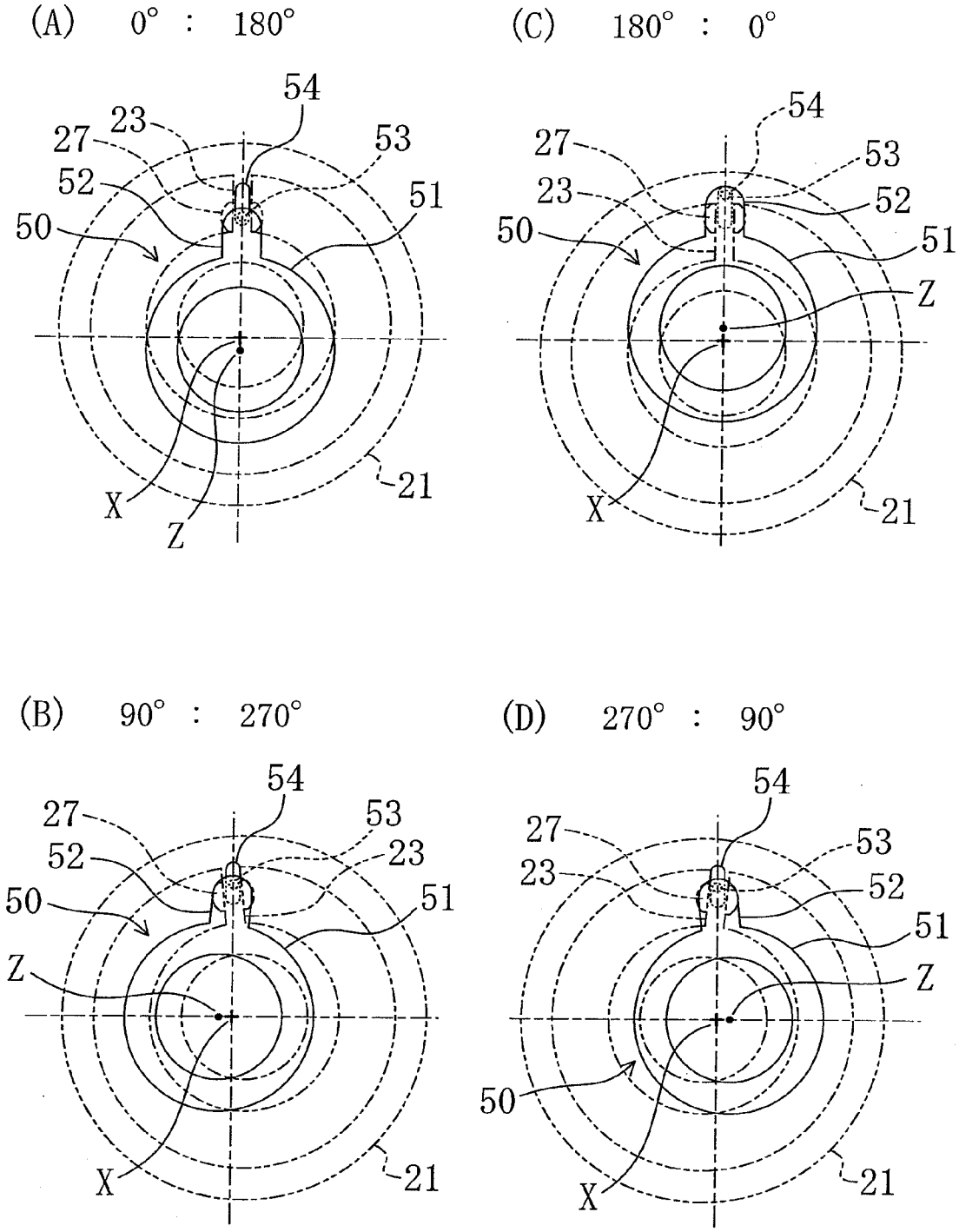
FIG. 4 illustrates schematic explanatory drawings showing an operation of the reverse moment generating mechanism.

The revolution body (51) is a member formed annually, as shown in FIGS. 3 and 4, and is rotatably fitted to the second eccentric part (33*b*) of the drive shaft (33). In the revolution body (51), a protrusion (52) is formed which protrudes outward in the radial direction. A downwardly extending pin (53) is formed at the protrusion (52). The revolution body (51) is made of a material having a specific gravity larger than that of the cylinder (21) as a movable member, and the examples of the material include cast iron and the like. The specific gravity of the revolution body (51) of cast iron may be increased by embedding brass therein.

The pin (53) is a single column-shaped cylindrical pin. The outer diameter of the pin (53) is slightly smaller than the width of the slide groove (54). A mounting hole for receiving the pin (53) is formed in advance in the lower surface of the protrusion (52), and the base end of the pin (53) is pressure inserted in the mounting hole. That is, the pin (53) is fixed to the revolution body (51) with its relative movement to the revolution body (51) prevented. It is noted that the pin (53) may be slackly fitted in the mounting hole of the protrusion (52) to be rotatable in the mounting hole.

On the other hand, the slide groove (54) is formed in the bottom (17*c*) of the recess (17*b*). Specifically, the slide groove (54) is located at the same angular position with respect to the rotation axis (X) of the drive shaft (33) as the swing bush (27). In other words, the slide groove (54) is formed at a point where it is aligned with the swing bush (27) on a straight line radially extending from the rotation axis (X) in a plan view. The lower housing (17) in which the slide groove (54) is formed is fixed to the casing (10), similarly to the upper housing (16) in which the annular piston (22) is formed. Therefore, the slide groove (54) is indirectly fixed to the annular piston (22).

The slide groove (54) is a concave having a predetermined width and linearly extending in substantially the radial direction of the rotation axis (X). The pin (53) of the revolution body (51) is fitted in the slide groove (54). That is, the revolution body (51) can freely move back and forth in the longitudinal direction of the slide groove (54), and is tunable about the pin (53) as a center. The pin (53) and the slide groove (54) serve as a revolution body support part, and the slide groove (54) serves as a guide part.

In the thus configured reverse moment generating mechanism (50), when the drive shaft (33) rotates, the revolution body (51) revolves about the rotation axis (X), and swings about the pin (53) as a swing center, while the pin (53) moves back and forth in the slide groove (54), as shown in FIG. 4A through to 4D.

—Driving Operation—

A driving operation of the compressor (1) will be described next.

When the motor (30) starts, the rotation of the rotor (32) is transmitted to the cylinder (21) of the compression mechanism (20) through the drive shaft (33). Then, the outside cylinder (24) and the inside cylinder (25) swing with respect to the annular piston (22) while revolving to cause the compression mechanism (20) to perform a predetermined compression operation. In this time, the blade (23) moves in a back and forth direction (reciprocates) between the bushes (27A, 27B), and swings integrally with the swing bushes (27A, 27B) with respect to the annular piston (22). In this time, the swing bushes (27A, 27B) are substantially in face contact with the sliding surfaces (P1, P2) of the annular piston (22) and the blade (23), respectively.

Specifically, as shown in FIG. 2, the cylinder (21) revolves. Suppose herein that the revolution angle of the cylinder (21) is zero degree when the swing center of the swing bush (27) and the axial center (Y) of the cylinder (21) (the axial center of the first eccentric part (33*a*)) are aligned on a straight line radially extending from the rotation axis (X) of the drive shaft (33) in a plan view (or, when the axial center (Y) of the cylinder (21) is located on a line segment connecting the rotation axis (X) to the swing bush (27)). FIG. 2(A) shows the state where the revolution angle of the cylinder (21) is zero degree or 360 degrees. FIG. 2(B) shows the state where it is 90 degrees. FIG. 2(C) shows the state where it is 180 degrees. FIG. 2(D) shows the state where it is 270 degrees.

In the outside cylinder chamber (C1), the volume of the low pressure chamber (C1-L) is almost zero in the state shown in FIG. 2(C). When the drive shaft (33) rotates clockwise in the drawing from this state to the state shown in FIG. 2(D), the low pressure chamber (C1-Lp) is formed. As the state proceeds from this state to the states shown in FIG. 2(A), to FIG. 2(B), then to FIG. 2(C), the volume of the low pressure chamber (C1-Lp) increases, so that the refrigerant is sucked into the low pressure chamber (C1-Lp) through the suction pipe (14), the low pressure space (S1), and the suction port (41). In this time, not all the refrigerant is directly sucked into the low pressure chamber (C1-Hp) from the suction port (41). Part of the refrigerant enters the suction space (42) from the suction port (41), and is then sucked into the low pressure chamber (C1-Lp) through the through hole (43).

When the drive shaft (33) makes one rotation to be in the state shown in FIG. 2(C) again, the refrigerant suction to the low pressure chamber (C1-Lp) terminates. Then, the low pressure chamber (C1-Lp) becomes the high pressure chamber (C1-Hp) next for compressing the refrigerant, and a new low pressure chamber (C1-Lp) isolated by the blade (23) is formed. When the drive shaft (33) further rotates, the refrigerant suction is repeated in the low pressure chamber (C1-Lp), while the volume of the high pressure chamber (C1-Hp) decreases to compress the refrigerant in the high pressure chamber (C1-Hp). When the pressure of the high pressure chamber (C1-Hp) becomes a predetermined value, and the pressure difference from the discharge space (49) reaches a set value, the high pressure refrigerant in the high pressure chamber (C1-Hp) opens the discharge valve (47) to flow from the discharge space (49) to the high pressure space (S2) through the discharge path (49*a*).

In the inside cylinder chamber (C2), the volume of the low pressure chamber (C2-Lp) in the states shown in FIG. 2(A) is almost zero. When the drive shaft (33) rotates clockwise in the drawing from this state to the state shown in FIG. 2(B), the low pressure chamber (C2-Lp) is formed. As the state proceeds from this state to the states shown in FIG. 2(C), to FIG. 2(D), then to FIG. 2(A), the volume of the low pressure chamber (C2-Lp) increases, so that the refrigerant is sucked into the low pressure chamber (C2-Lp) through the suction pipe (14), the low pressure space (S1), and the suction port (41). In this time, not all the refrigerant is directly sucked into the low pressure chamber (C2-Lp) from the suction port (41). Part of the refrigerant enters the suction space (42) from the suction port (41), and is then sucked into the low pressure chamber (C2-Lp) of the inside cylinder chamber (C2) through the through hole (43), the low pressure chamber (C1-Lp) of the outside cylinder chamber, and the through hole (44).

When the drive shaft (33) makes one rotation to be in the state shown in FIG. 2(A) again, the refrigerant suction to the low pressure chamber (C2-Lp) terminates. Then, the low pressure chamber (C2-Lp) becomes the high pressure chamber (C2-Hp) next for compressing the refrigerant, and a new low pressure chamber (C2-Lp) isolated by the blade (23) is formed. When the drive shaft (33) further rotates, the refrigerant suction is repeated in the low pressure chamber (C2-Lp), while the volume of the high pressure chamber (C2-Hp) decreases to compress the refrigerant in the high pressure chamber (C2-Hp). When the pressure of the high pressure chamber (C2-Hp) becomes a predetermined value, and the pressure difference from the discharge space (49) reaches a set value, the high pressure refrigerant in the high pressure chamber (C2-Hp) opens the discharge valve (48) to flow from the discharge space (49) to the high pressure space (S2) through the discharge path (49*a*).

In this way, the high pressure refrigerant compressed in the outside cylinder chamber (C1) and the inside cylinder chamber (C2) and flowing in the high pressure space (S2) is discharged from the discharge pipe (15), undergoes the condensation stroke, the expansion stroke, and the evaporation stroke in a refrigerant circuit, and is then sucked into the compressor (1) again.

Thus, during the time when revolution of the cylinder (21) compresses the refrigerant, since the blade (23) is in engagement with the swing bush (27), the cylinder (21) swings about the swing bush (27) as a center. That is, the rotation of the cylinder (21) is limited so that the blade (23) is directed at the swing bush (27), and the rotation speed and direction of the cylinder (21) change according to the relative positional relationship between the cylinder (21) and the swing bush (27). Thus, rotation moment is generated at the cylinder (21). Since the swing bush (27) limits the rotation of the cylinder (21), the reaction force against the rotation moment of the cylinder (21) acts on the swing bush (27). As a result, the moment caused by the reaction force about the rotation axis (X) acts on the compressor (1). Also, a load acts on the first eccentric part (33*a*) by the rotation moment of the cylinder (21). As a result, the moment caused by the load to the first eccentric part (33*a*) acts on the drive shaft (33) at which the first eccentric part (33*a*) is provided. However, the reverse moment generating mechanism (50) works to cancel the moment caused by the rotation including the moment caused by the reaction force and the moment caused by the load.

Herein, an operation of the reverse moment generating mechanism (50) will be described in detail with reference to FIG. 4.

Suppose herein that the revolution angle of the revolution body (51) is zero degree when the pin (53) and the axial center (Z) of the revolution body (51) (the axial center of the second eccentric part (33*b*)) are aligned on a straight line radially extending from the rotation axis (X) of the drive shaft (33) in a plan view (or, when the axial center (Z) of the revolution body (51) is located on a line segment connecting the rotation axis (X) to the slide groove (54)). In each of FIGS. 4(A) to 4(D), the values of the revolution angles of the cylinder (21) and the revolution body (51) are indicated first and second, respectively. In the present example embodiment, the cylinder (21) is eccentric on the opposite side of the rotation axis (X) to the revolution body (51), and the angular position about the rotation axis (X) of the swing bush (27) determining the reference point of the revolution angle of the cylinder (21) agrees with that of the pin (53) and that of the slide groove (54) determining the reference point of the revolution angle of the revolution body (51). Accordingly, the revolution angle of the cylinder (21) is shifted by 180 degrees from that of the revolution body (51).

First, as shown in FIG. 4(A), when the revolution angle of the cylinder (21) is zero degree, the cylinder (21) is located at the twelve o'clock position with respect to the rotation axis (X), while the revolution body (51) is located at the six o'clock position with respect to the rotation axis (X). That is, the revolution body (51) is consistently shifted by 180 degrees from the cylinder (21) with respect to the rotation axis (X).

When the drive shaft (33) rotates clockwise from the above state, the cylinder (21) revolves to the three o'clock position with respect to the rotation axis (X), while the revolution body (51) revolves clockwise to the nine o'clock position with respect to the rotation axis (X). In this time, the cylinder (21) is revolves while rotating counterclockwise so that the blade (23) is directed at the swing bush (27). The rotation speed of this rotation decreases as the revolution angle of the cylinder (21) increases from zero degree. When the revolution angle is substantially 90 degrees (specifically, when the swing angle of the cylinder (21) in one direction about the swing bush (27) as a center is maximum), the rotation speed becomes zero. Thereafter, the rotation direction is switched. Referring to the revolution body (51), it revolves while rotating so that the pin (53) is directed at the slide groove (54). Since the cylinder (21) is eccentric on the opposite side of the rotation axis (X) to the revolution body (51), and the angular position of the swing bush (27) about the rotation axis (X) as the swing center of the cylinder (21) agrees with that of the pin (53) and that of the slide groove (51) about the rotation axis (X) as the swing center of the slide groove (51), the rotation direction of the revolution body (51) is the counterclockwise direction reverse to the rotation direction of the cylinder (21). The rotation speed of this rotation decreases as the revolution angle of the revolution body (51) increases from 180 degrees. When the revolution angle thereof is substantially 270 degrees, (specifically, when the swing angle of the revolution body (51) in the other direction about the pin (53) as a center is maximum), the rotation speed thereof becomes zero. Thereafter, the rotation direction is switched.

Subsequently, when the drive shaft (33) further rotates clockwise, as shown in FIGS. 4(C) and 4(D), the cylinder (21) revolves from the three o'clock position to the six o'clock position, then to the nine o'clock position with respect to the rotation axis (X), while the revolution body (51) revolves clockwise from the nine o'clock position to the twelve o'clock position, then to the three o'clock position. In this time, the cylinder (21) rotates clockwise so that the blade (23) is directed at the swing bush (27). The rotation speed of this rotation increases as the revolution angle of the cylinder (21) increases from 90 degrees. When the revolution angle becomes 180 degrees, the rotation speed becomes maximum. The rotation speed decreases as the revolution angle increases from 180 degrees. When the revolution angle becomes substantially 270 degrees (specifically, when the swing angle of the cylinder (21) in the other direction about the swing bush (27) as a center becomes maximum), the rotation speed becomes zero. Thereafter, the rotation direction is switched. Referring to the revolution body (51), it rotates counterclockwise so that the pin (53) is directed at the slide groove (54). The rotation speed of this rotation increases as the revolution angle of the revolution body (51) increases from 270 degrees. When the revolution angle becomes 360 degrees (zero degree), the rotation speed becomes maximum. The rotation speed decreases as the revolution angle increases from zero degree. When the revolution angle becomes substantially 90 degrees (specifically, when the swing angle of the revolution body (51) in the one direction about the pin (53) as a center becomes maximum), the rotation speed becomes zero. Thereafter, the rotation direction is switched.

When the drive shaft (33) further revolves clockwise from the above state, as shown in FIG. 4(A), the cylinder (21)

revolves clockwise from the nine o'clock position to the twelve o'clock position with respect to the rotation axis (X), while the revolution body (51) revolves clockwise from the three o'clock position to the six o'clock position with respect to the rotation axis (X). In this time, the cylinder (21) rotates counterclockwise so that the blade (23) is directed at the swing bush (27). The rotation speed of this rotation increases as the revolution angle of the cylinder (21) increases from 270 degrees. When the revolution angle becomes 360 degrees (zero degree), the rotation speed becomes maximum. Referring to the revolution body (51), it rotates clockwise so that the pin (53) is directed at the slide groove (54). The rotation speed of this rotation increases as the revolution angle of the revolution body (51) increases from 90 degrees. When the revolution angle becomes 180 degrees, the rotation speed becomes maximum.

In this way, when the cylinder (21) makes one revolution about the rotation axis (X), the revolution body (51) also makes one revolution about the rotation axis (X). Here, the revolution body (51) and the cylinder (21) rotate in the reverse direction to each other, as described above. As the rotation speed of the cylinder (21) increases, the rotation speed of the revolution body (51) (in the reverse direction) increases also. In reverse, as the rotation speed of the cylinder (21) decreases, the rotation speed of the revolution body (51) (in the reverse direction) also decreases. As a result, rotation moment having a center at the first eccentric part (33*a*) is generated at the cylinder (21), while rotation moment having a center at the second eccentric center (33*b*), which is in the reverse direction to that of the rotation moment of the cylinder (21), is generated at the revolution body (51).

The rotation of the cylinder (21) is limited by the swing bush (27), as described above, and therefore, the reaction force against the rotation moment acts on the swing bush (27). This reaction force acts on the compressor (1) as moment about the rotation axis (X), namely, moment caused by the reaction force. On the other hand, the rotation of the revolution body (51) is also limited by the slide groove (54), so that the reaction force against the rotation moment acts on the slide groove (54). This reaction force acts on the compressor (1) as moment caused by the reaction force about the rotation axis (X). Since the rotation direction of the cylinder (21) is reverse to that of the revolution body (51), the direction of the reaction force against the rotation moment acting on the swing bush (27) is reverse about the rotation axis (X) to that of the reaction force against the rotation moment acting on the slide groove (54). In other words, the moment caused by the reaction force of the cylinder (21) and that of the revolution body (51) act in the directions canceling each other about the rotation axis (X).

Further, as described above, the cylinder (21) is mounted at the first eccentric part (33*a*), and therefore, a load acts on the first eccentric part (33*a*) by the rotation moment of the cylinder (21). This load acts on the drive shaft (33) through the first eccentric part (33*a*) as moment about the rotation axis (X), namely, moment caused by the load. On the other hand, the revolution body (51) is mounted at the second eccentric part (33*b*), and therefore, a load acts on the second eccentric part (33*b*) by the rotation moment of the revolution body (51). This load acts on the drive shaft (33) through the second eccentric part (33*b*) as moment caused by the load about the rotation axis (X). Since the rotation direction of the cylinder (21) is reverse to that of the revolution body (51), the moment caused by the load of the cylinder (21) and the moment caused by the load of the revolution body (51), which act on the drive shaft (33), act in the directions canceling each other about the rotation axis (X).

Thus, the moment caused by the rotation of the cylinder (21) and that of the moment caused by the rotation of the revolution body (51) cancel each other, thereby suppressing vibration of the compressor (1).

Advantages of Example Embodiment 1

Thus, in Example Embodiment 1, the revolution body (51) eccentric on the opposite side of the rotation axis (X) of the drive shaft (33) to the cylinder (21) is provided, and the slide groove (54) supporting the pin (53) of the revolution body (51) is arranged at the same angular position about the rotation axis (X) as the swing bush (27) supporting the cylinder (21). This causes the moment caused by the rotation of the cylinder (21) acting about the rotation axis (X) to be cancelled by the moment caused by the rotation of the revolution body (51) in the reverse direction, thereby reducing vibration of the compressor (1).

It is noted that in order to sufficiently cancel the moment caused by the rotation of the cylinder (21), it is preferable to balance the amount of the moment caused by the rotation of the cylinder (21) with that of the revolution body (51). To do so, in Example Embodiment 1, the cylinder (21) is made of an aluminum alloy, while the revolution body (51) is made of cast iron having a specific gravity larger than that of the aluminum alloy. This can reduce the size of the revolution body (51), and can generate moment for sufficiently canceling the moment caused by the rotation of the cylinder (21).

Example Embodiment 2

In contrast to Example Embodiment 1, which is an example where the annular piston (22) serves as a fixed member, while the cylinder (21) serves as a movable member, Example Embodiment 2 of the present invention supposes a cylinder (221) and an annular piston (222) to be a fixed member and a movable member, respectively. The same reference numerals are assigned to those having the same configurations as in Example Embodiment 1 for omitting the description thereof.

Figure 5:
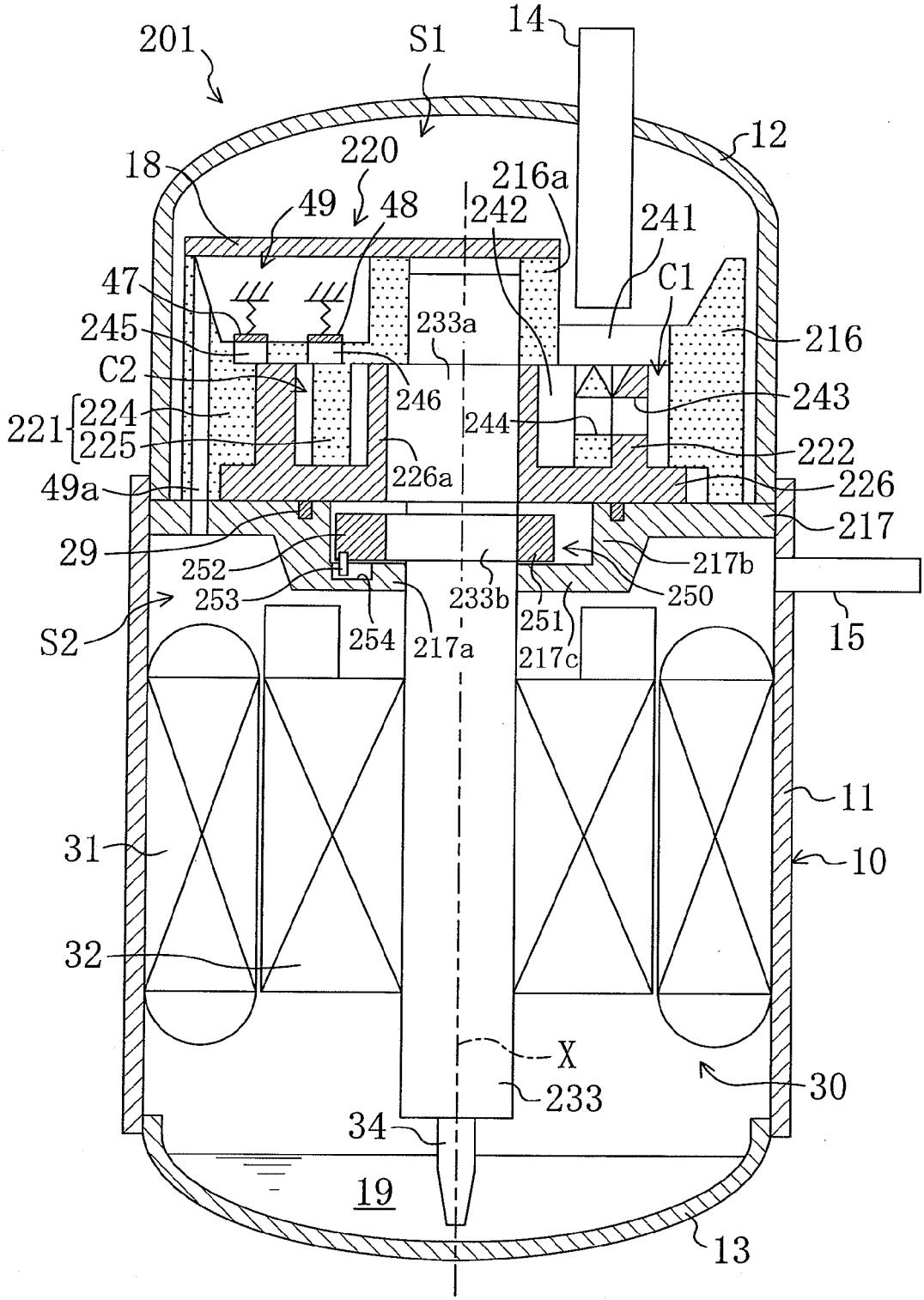
FIG. 5 is a vertical cross-section of a compressor in accordance with Example Embodiment 2 of the present invention.

In Example Embodiment 2, as shown in FIG. 5, the compressor (20) is arranged between an upper housing (216) and a lower housing (217) in the upper part of the casing (10), similarly to the case of Example Embodiment 1.

Unlike Example Embodiment 1, an outside cylinder (224) and an inside cylinder (225) are provided in the upper housing (216). The outside cylinder (224) and the inside cylinder (225) are integrated with the upper housing (216) to form a cylinder (221).

Between the upper housing (216) and the lower housing (217), the annular piston (222) is held. The annular piston (222) is integrated with an end plate (226). The end plate (226) is provided with a hub (226*a*) slidably fitted to a first eccentric part (233*a*) of a drive shaft (233). Accordingly, in this structure, when the drive shaft (233) rotates, the annular piston (222) revolves in the cylinder chamber (C1, C2). The blade (23) is formed integrally with the cylinder (221), similarly to that in Example Embodiment 1. The blade (23) and the swing bush (27) serve as a movable member support part.

In the upper housing (216), a suction port (241), a discharge port (245) in the outside cylinder chamber (C1), and a discharge port (246) in the inside cylinder chamber (C2) are formed. The suction port (241) allows the outside cylinder chamber (C1) and the inside cylinder chamber (C2) to communicate with the low pressure space (S1) above a compression mechanism (220) in the casing (10). A suction space (242) communicating with the suction port (241) is formed between the hub (226*a*) and the inside cylinder (225). A through hole (244) and a through hole (243) are formed in the inside cylinder (225) and the annular piston (222), respectively. The upper end parts of the annular piston (222) and the inside cylinder (225) which correspond to the suction port (241) are chamfered.

Above the compression mechanism (220), a cover plate (18) is provided to form a discharge space (49) between it and the upper housing (216). The discharge space (49) communicates with the high pressure space (S2) below the compression mechanism (220) through the discharge path (49*a*) formed in the upper housing (216) and the lower housing (217).

In the central part of the lower housing (217), a recess (217*b*) is formed, similarly to that in Example Embodiment 1. In the recess (217*b*), a second eccentric part (233*b*) of the drive shaft (233) is disposed, and a reverse moment generating mechanism (250) is provided.

In contrast to Example Embodiment 1, the second eccentric part (233*b*) is eccentric on the same side of the rotation axis (X) of the drive shaft (233) as the first eccentric part (233*a*).

The reverse moment generating mechanism (250) includes a revolution body (251) provided at the second eccentric part (233*b*) of the drive shaft (233), and a slide groove (254) supporting the revolution body (251).

The revolution body (251) has the same configuration as the revolution body (51) in Example Embodiment 1. That is, the revolution body (251) is an annular member rotatably fitted to the second eccentric part (233*b*) of the drive shaft (233). In the revolution body (251), a protrusion (252) is formed to protrude radially outward, and a pin (253) is provided to extend downward from the protrusion (252).

On the other hand, the slide groove (254) is formed in the bottom (217*c*) of the recess (217*b*). In the slide groove (254), the pin (253) of the revolution body (251) is fitted to move back and forth in the longitudinal direction of the slide groove (254) and to rotate in the slide groove (254). Unlike the slide groove (54) in Example Embodiment 1, the slide groove (254) is disposed at an angular position about the rotation axis (X) of the drive shaft (233) which is shifted by 180 degrees from the angular position of the blade (23). In other words, the slide groove (254) and the blade (26) are aligned on a straight line with the rotation axis (X) interposed in a plan view. The pin (253) and the slide groove (254) serve as a revolution body support part, and the slide groove (254) serves as a guide part. The lower housing (217) in which the slide groove (254) is formed is fixed to the casing (10), similarly to the upper housing (216) in which the cylinder (221) is formed. Therefore, the slide groove (254) is fixed indirectly to the cylinder (221).

—Driving Operation—

The driving operation of the compressor (201) is the same as that in Example Embodiment 1, except that the annular piston (222) revolves rather than the cylinder (221).

Figure 6:
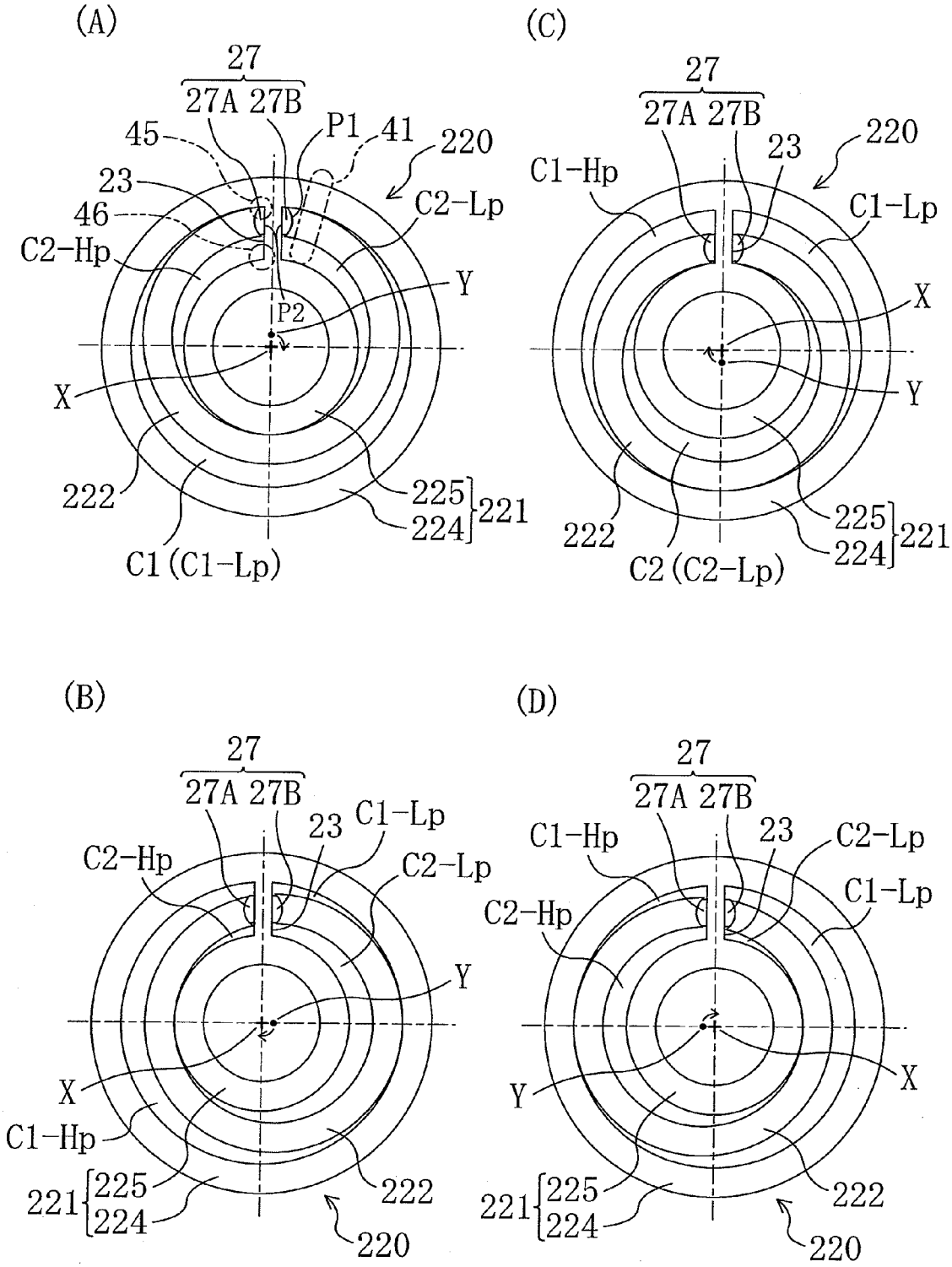
FIG. 6 illustrates schematic explanatory drawings showing an operation of a compression mechanism.

Specifically, as shown in FIG. 6, the annular piston (222) revolves. The revolution angle of the annular piston (222) is supposed to be zero degree when the swing center of the swing bush (27) and the axial center (Y) of the annular piston (222) (the axial center of the first eccentric part (233*a*)) are aligned on a straight line radially extending from the rotation axis (X) of the drive shaft (233) in a plan view (or, when the axial center (Y) of the annular piston (222) is located on a line segment connecting the rotation axis (X) to the blade (23)). FIG. 6(A) shows the state where the revolution angle of the annular piston (222) is zero degree or 360 degrees. FIG. 6(B) shows the state where it is 90 degrees. FIG. 6(C) shows the state where it is 180 degrees. FIG. 6(D) shows the state where it is 270 degrees.

In the outside cylinder chamber (C1), the volume of the low pressure chamber (C1-Lp) is almost zero in the state shown in FIG. 6(A). When the drive shaft (233) rotates clockwise in the drawing from this state to the state shown in FIG. 6(B), the low pressure chamber (C1-Lp) is formed. As the state proceeds from this state to the state shown in FIG. 6(C), to FIG. 6(D), then to FIG. 6(A), the volume of the low pressure chamber (C1-Lp) increases, so that the refrigerant is sucked into the low pressure chamber (C1-Lp) through the suction pipe (14), the low pressure space (S1), and the suction port (241).

When the drive shaft (233) makes one rotation to be in the state shown in FIG. 6(A) again, the refrigerant suction to the low pressure chamber (C1-Lp) terminates. Then, the low pressure chamber (C1-Lp) becomes the high pressure chamber (C1-Hp) next for compressing the refrigerant, and a new low pressure chamber (C1-Lp) isolated by the blade (23) is formed. When the drive shaft (233) further rotates, the refrigerant suction is repeated in the low pressure chamber (C1-Lp), while the volume of the high pressure chamber (C1-Hp) decreases to compress the refrigerant in the high pressure chamber (C1-Hp). When the pressure of the high pressure chamber (C1-Hp) becomes a predetermined value, and the pressure difference from the discharge space (49) reaches a set value, the high pressure refrigerant in the high pressure chamber (C1-Hp) opens the discharge valve (47) to flow from the discharge space (49) to the high pressure space (S2) through the discharge path (49*a*).

On the other hand, in the inside cylinder chamber (C2), the volume of the low pressure chamber (C2-Lp) in the states shown in FIG. 6(C) is almost zero. When the drive shaft (233) rotates clockwise in the drawing from this state to the state shown in FIG. 6(D), the low pressure chamber (C2-Lp) is formed. As the state proceeds from this state to the states shown in FIG. 6(A), to FIG. 6(B), then to FIG. 6(C), the volume of the low pressure (C2-Lp) increases, so that the refrigerant is sucked into the low pressure chamber (C2-Lp) through the suction pipe (14), the low pressure space (S1), and the suction port (241).

When the drive shaft (33) makes one rotation to be in the state shown in FIG. 6(C) again, the refrigerant suction to the low pressure chamber (C2-Lp) terminates. Then, the low pressure chamber (C2-Lp) becomes the high pressure chamber (C2-Hp) next for compressing the refrigerant, and a new low pressure chamber (C2-Lp) isolated by the blade (23) is formed. When the drive shaft (233) further rotates, the refrigerant suction is repeated in the low pressure chamber (C2-Lp), while the volume of the high pressure chamber (C2-Hp) decreases to compress the refrigerant in the high pressure chamber (C2-Hp). When the pressure of the high pressure chamber (C2-Hp) becomes a predetermined value, and the pressure difference from the discharge space (49) reaches a set value, the high pressure refrigerant in the high pressure chamber (C2-Hp) opens the discharge valve (48) to flow from the discharge space (49) to the high pressure space (S2) through the discharge path (49*a*).

In this way, during the time when the revolution of the annular piston (222) compresses the refrigerant, since the swing bush (27) is in engagement with the blade (23), the annular piston (222) rotates so that the swing bush (27) is directed at the blade (23). That is, the rotation of the annular piston (222) is limited so that the swing bush (27) is directed at the blade (23), and the rotation speed and direction of the annular piston (222) change according to the relative positional relationship between the annular piston (222) and the blade (23). Thus, rotation moment is generated at the annular piston (222). Since the rotation of the annular piston (222) is limited by the blade (23), the reaction force against the rotation moment of the annular piston (222) acts on the blade (23). As a result, the moment caused by the reaction force about the rotation axis (X) acts on the compressor (201). Also, a load acts on the first eccentric part (233*a*) by the rotation moment of the annular piston (222). Accordingly, the moment caused by the load to the first eccentric part (233*a*) acts on the drive shaft (233) at which the first eccentric part (233*a*) is provided. However, the reverse moment generating mechanism (250) works to cancel the moment caused by the rotation including the moment caused by the reaction force and the moment caused by the load.

Figure 7:
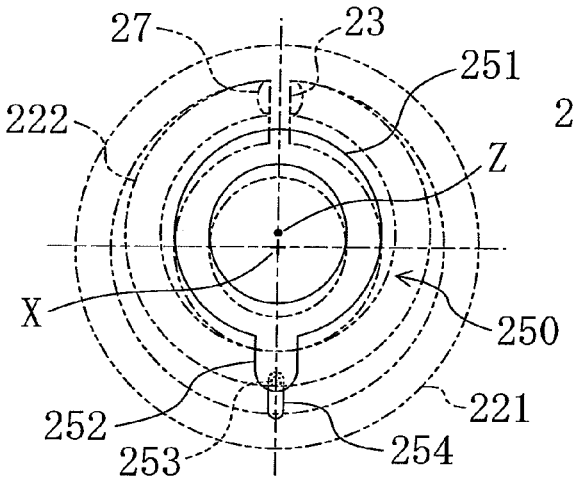
FIG. 7 illustrates schematic explanatory drawings showing an operation of a reverse moment generating mechanism.
Figure 7:
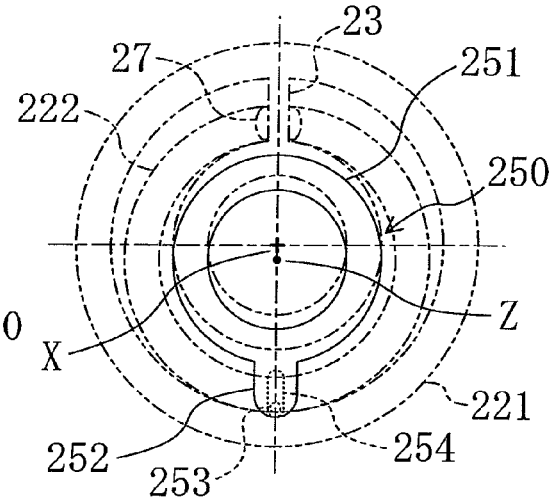
Figure 7:
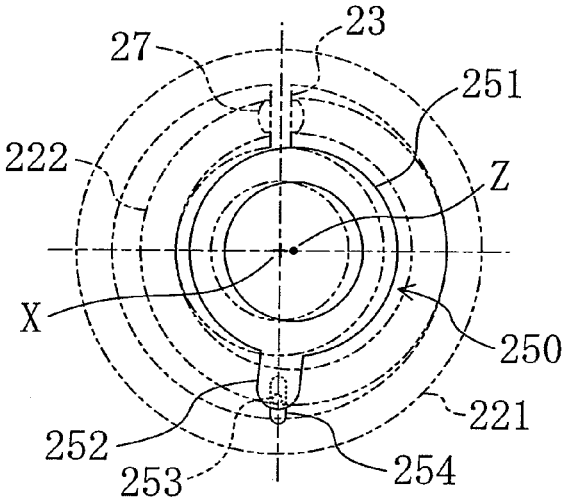
Figure 7:
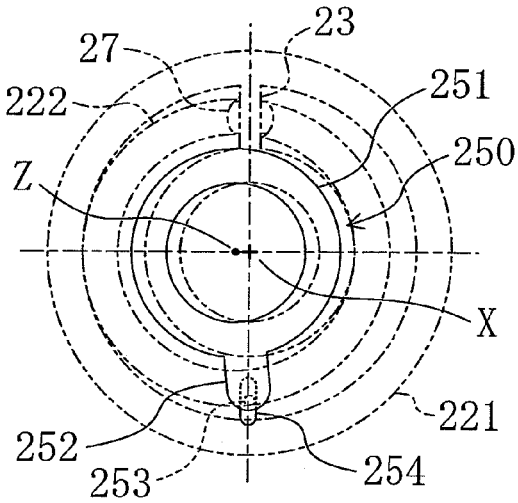

Herein, an operation of the reverse moment generating mechanism (250) will be described in detail with reference to FIG. 7.

Suppose herein that the revolution angle of the revolution body (251) is zero degree when the pin (253) and the axial center (Z) of the revolution body (251) (the axial center of the second eccentric part (233*b*)) are aligned on a straight line radially extending from the rotation axis (X) of the drive shaft (233) in a plan view (or, where the axial center (Z) of the revolution body (251) is located on a line segment connecting the rotation axis (X) to the slide groove (254)). In each of FIGS. 7(A) to 7(D), the values of the revolution angles of the annular piston (222) and the revolution body (251) are indicated first and second, respectively. In the present example embodiment, the annular piston (222) is eccentric on the same side of the rotation axis (X) as the revolution body (251), and the angular position of the blade (23) determining the reference point of the revolution angle of the annular piston (222) is shifted by 180 degrees about the rotation axis (X) from that of the pin (253) and that of the slide groove (254) determining the reference point of the revolution angle of the revolution body (251). Accordingly, the revolution angle of the annular piston (222) is shifted by 180 degrees from that of the revolution body (251).

First, as shown in FIG. 7(A), when the revolution angle of the annular piston (222) is zero degree, the annular piston (222) and the revolution body (251) are located at the twelve o'clock position with respect to the rotation axis (X). However, the revolution angle of the revolution body (251), which is shifted by 180 degrees from the revolution angle of the annular piston (222), is 180 degrees.

When the drive shaft (233) rotates clockwise from the above state, the annular piston (222) and the revolution body (251) revolve to the three o'clock position with respect to the rotation axis (X). In this time, the annular piston (222) revolves while rotating counterclockwise so that the swing bush (27) is directed at the blade (23). The rotation speed of this rotation decreases as the revolution angle of the annular piston (222) increases from zero degree. When the revolution angle becomes substantially 90 degrees (specifically, when the swing angle of the annular piston (222) in one direction about the swing bush (27) as a center is maximum), the rotation speed becomes zero. Thereafter, the rotation direction is switched. Referring to the revolution body (251), it revolves while rotating so that the pin (253) is directed at the slide groove (254). The annular piston (222) is eccentric on the same side of the rotation axis (X) as the revolution body (251), and the angular position of the blade (23) and the angular position of the swing bush (27) as the swing center of the annular piston (222) are shifted by 180 degrees about the rotation axis (X) from that of the pin (253) and that of the slide groove (254) as the swing center of the revolution body (251). Therefore, the rotation direction of the revolution body (251) is the clockwise direction reverse to the rotation direction of the annular piston (222). The rotation speed of this rotation decreases as the revolution angle of the revolution body (251) increases from 180 degrees. When the revolution angle becomes substantially 270 degrees, (specifically, when the swing angle of the revolution body (251) in the one direction about the pin (253) is maximum), the rotation speed becomes zero. Thereafter, the rotation direction is switched.

When the drive shaft (233) further rotates clockwise thereafter, as shown in FIGS. 7(C) and 7(D), the annular piston (222) and the revolution body (251) revolve clockwise from the three o'clock position to the six o'clock position, and then to the nine o'clock position with respect to the rotation axis (X). In this time, the annular piston (222) revolves clockwise so that the swing bush (27) is directed at the blade (23). The rotation speed of this rotation increases as the revolution angle of the annular piston (222) increases from 90 degrees. When the revolution angle becomes 180 degrees, the rotation speed becomes maximum. The rotation speed decreases as the revolution angle increases from 180 degrees. When the revolution angle becomes substantially 270 degrees, (specifically, when the swing angle of the annular piston (222) in the other direction about the swing bush (27) as a center is maximum), the rotation speed becomes zero. Thereafter, the rotation direction is switched. Referring to the revolution body (251), it rotates counterclockwise so that the pin (253) is directed at the slide groove (254). The rotation speed of this rotation increases as the revolution angle of the revolution body (251) increases from 270 degrees. When the revolution angle becomes 360 degrees (zero degree), the rotation speed becomes maximum. The rotation speed decreases as the revolution angle increases from zero degree. When the revolution angle becomes substantially 90 degrees, (specifically, when the swing angle of the revolution body (251) in the other direction about the pin (253) as a center is maximum), the rotation speed becomes zero. Thereafter, the rotation direction is switched.

When the drive shaft (233) further rotates clockwise from the above state, as shown in FIG. 7(A), the annular piston (222) and the revolution body (251) revolve clockwise from the nine o'clock position to the twelve o'clock position with respect to the rotation axis (X). In this time, the annular piston (222) revolves counterclockwise so that the swing bush (27) is directed at the blade (23). The rotation speed of this rotation increases as the revolution angle of the annular piston (222) increases from 270 degrees. When the revolution angle becomes 360 degrees (zero degree), the rotation speed becomes maximum. Referring to the revolution body (251), it rotates clockwise so that the pin (253) is directed at the slide groove (254). The rotation speed of this rotation increases as the revolution angle of the revolution body (251) increases from 90 degrees. When the revolution angle becomes 180 degrees, the rotation speed becomes maximum.

In this way, when the annular piston (222) makes one revolution about the rotation axis (X), the revolution body (251) also makes one revolution about the rotation axis (X). Here, the revolution body (251) and the annular piston (222) rotate in the reverse direction to each other. As the rotation speed of the annular piston (222) increases, the rotation speed of the revolution body (251) (in the reverse direction) increases also. In reverse, as the rotation speed of the annular piston (222) decreases, the rotation speed of the revolution body (251) (in the reverse direction) also decreases. As a result, rotation moment having a center at the first eccentric part (233*a*) is generated at the annular piston (222), while rotation moment having a center at the second eccentric center (233*b*), which is in the reverse direction to that of the rotation moment of the annular piston (222), is generated at the revolution body (251).

As described above, the rotation of the annular piston (222) is limited by the blade (23), and therefore, the reaction force against the rotation moment acts on the blade (23). This reaction force acts on the compressor (201) as moment about the rotation axis (X), namely, moment caused by the reaction force. On the other hand, the rotation of the revolution body (251) is also limited by the slide groove (254), so that the reaction force against the rotation moment acts on the slide groove (254). This reaction force acts on the compressor (201) as moment caused by the reaction force about the rotation axis (X). Since the rotation direction of the annular piston (222) is reverse to that of the revolution body (251), the direction of the reaction force of the rotation moment acting on the blade (23) is reverse about the rotation axis (X) to that of the reaction force of the rotation moment acting on the slide groove (254). In other words, the moment caused by the reaction force of the annular piston (222) and that of the revolution body (251) act in the directions canceling each other about the rotation axis (X).

Further, as described above, the annular piston (222) is mounted at the first eccentric part (33*a*), and therefore, a load acts on the first eccentric part (233*a*) by the rotation moment of the annular piston (222). This load acts on the drive shaft (233) through the first eccentric part (233*a*) as moment about the rotation axis (X), namely, moment caused by the load. On the other hand, the revolution body (251) is mounted at the second eccentric part (233*b*), and therefore, a load acts on the second eccentric part (233*b*) by the rotation moment of the revolution body (251). This load acts on the drive shaft (233) through the second eccentric part (233*b*) as moment caused by the load about the rotation axis (X). Since the rotation direction of the annular piston (222) is reverse to that of the revolution body (251), the moment caused by the load of the annular piston (222) and the moment caused by the load of the revolution body (251), which act on the drive shaft (233), act in the directions canceling each other about the rotation axis (X).

Thus, the moment caused by the rotation of the annular piston (222) and the moment caused by the rotation of the revolution body (251) cancel each other, thereby suppressing vibration of the compressor (201).

Advantages of Example Embodiment 2

Thus, in Example Embodiment 2, the revolution body (251) eccentric on the same side of the rotation axis (X) of the drive shaft (233) as the annular piston (222) is provided, and the slide groove (254) supporting the pin (253) of the revolution body (251) is shifted by 180 degrees about the rotation axis (X) from the blade (23) supporting the annular piston (222). This causes the moment caused by the rotation of the annular piston (222) acting about the rotation axis (X) to be cancelled by the moment caused by the rotation of the revolution body (251) in the reverse direction, thereby reducing vibration of the compressor (201).

Example Embodiment 3

In Example Embodiments 1 and 2, the compression mechanisms (20, 220) form the inside cylinder chamber and the outside cylinder chamber inside and outside the annular piston (22, 222), respectively. Example Embodiment 3 of the present invention is different therefrom in that a cylinder chamber is formed only outside a circular piston.

Specifically, in Example Embodiment 3, a cylinder chamber (C) is in a circular shape in section across its axis at a right angle, and the piston is configured as a circular piston (322) accommodated eccentrically in the cylinder chamber (C) so that the cylinder chamber (C) is not defined into two inside and outside cylinder chambers.

Figure 8:
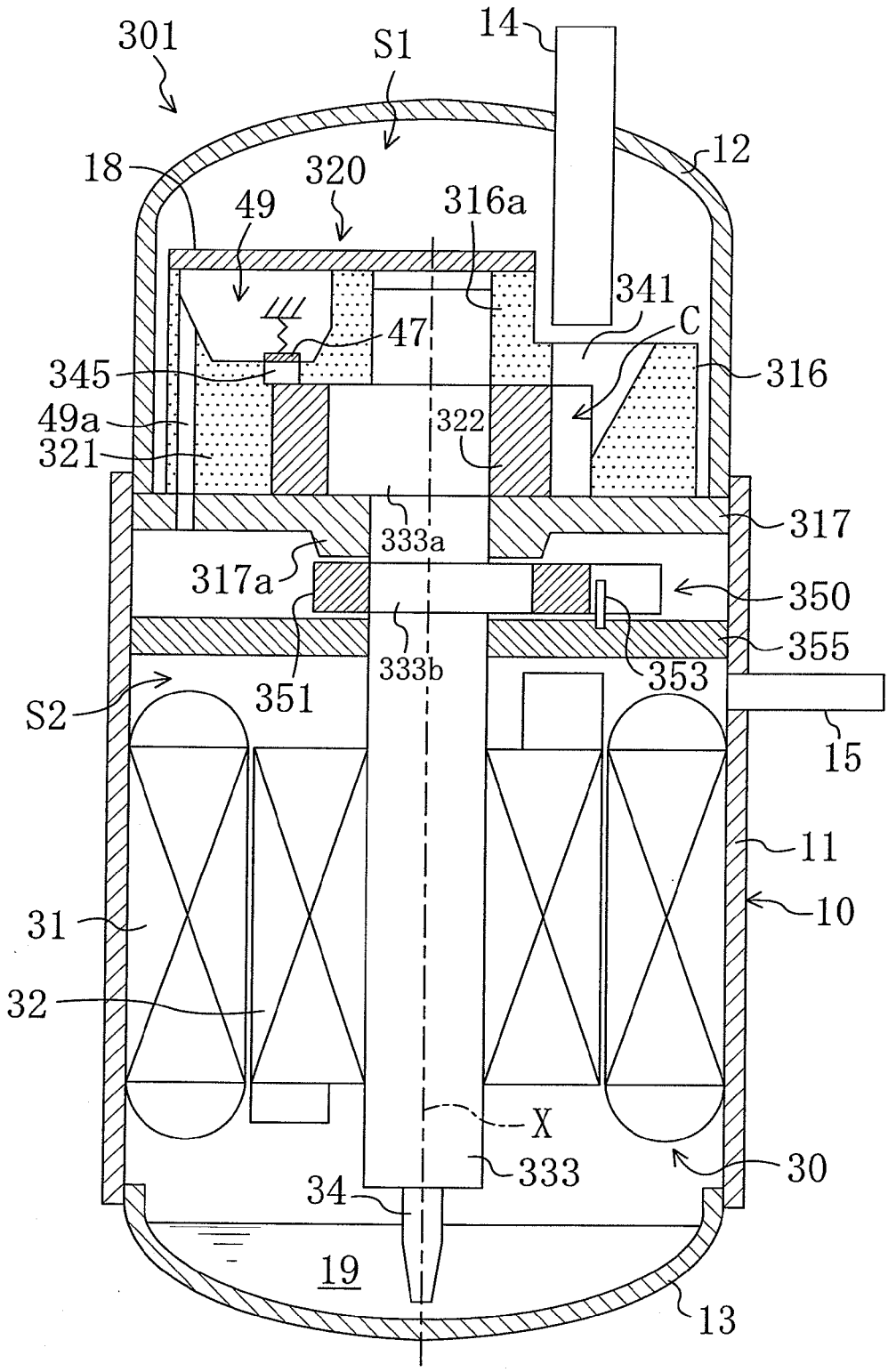
FIG. 8 is a vertical cross-section of a compressor in accordance with Example Embodiment 3 of the present invention.

A compression mechanism (320) is disposed between a lower housing (317) fixed to the casing (10) and an upper housing (317) fixed to the lower housing (317), as shown in FIG. 8. The compression mechanism (320) includes a cylinder (321) having the cylinder chamber (C) circular in section across its axis at a right angle, the circular piston (322) disposed in the cylinder chamber (C), and a blade (323) defining the cylinder chamber (C) into a high pressure chamber (a compression chamber) (C-Hp) and a low pressure chamber (a suction chamber) (C-Lp). In Example Embodiment 3, the cylinder (321) including the cylinder chamber (C) serves as a fixed member, while the circular piston (322) disposed in the cylinder chamber (C) serves as a movable member. The circular piston (322) revolves with respect to the cylinder (321).

A drive shaft (333) of the motor (30) includes a first eccentric part (333*a*) formed at a part corresponding to the circular piston (322), and a second eccentric part (333*b*) formed below the first eccentric part (333*a*). The first and second eccentric parts (333*a*, 333*b*) have diameters larger than parts above and below the first and second eccentric parts (33*a*, 33*b*), and are eccentric by predetermined amounts in the opposite sides of the rotation axis (X) to each other. The circular piston (322) is rotatably fitted to the first eccentric part (333*a*).

The cylinder (321) including the cylinder chamber (C) is formed in the upper housing (316). A blade accommodating space (316*b*) is formed in the inner peripheral wall of the cylinder (321) which defines the cylinder chamber (C). The swing bush (27) is rotatably held at the end of the blade accommodating space (316*b*) on the side of the cylinder chamber (C).

In the upper housing (316) and the lower housing (317), bearings (316*a*, 317*a*) are respectively formed for supporting the drive shaft (333). Accordingly, the compressor (301) in the present example embodiment is in an axis passing structure in which the drive shaft (333) vertically passes through the cylinder chamber (C), and the respective one side parts in the axial direction of the first eccentric part (333*a*) are held by the casing (10) through the bearings (316*a*, 317*a*).

Figure 9:
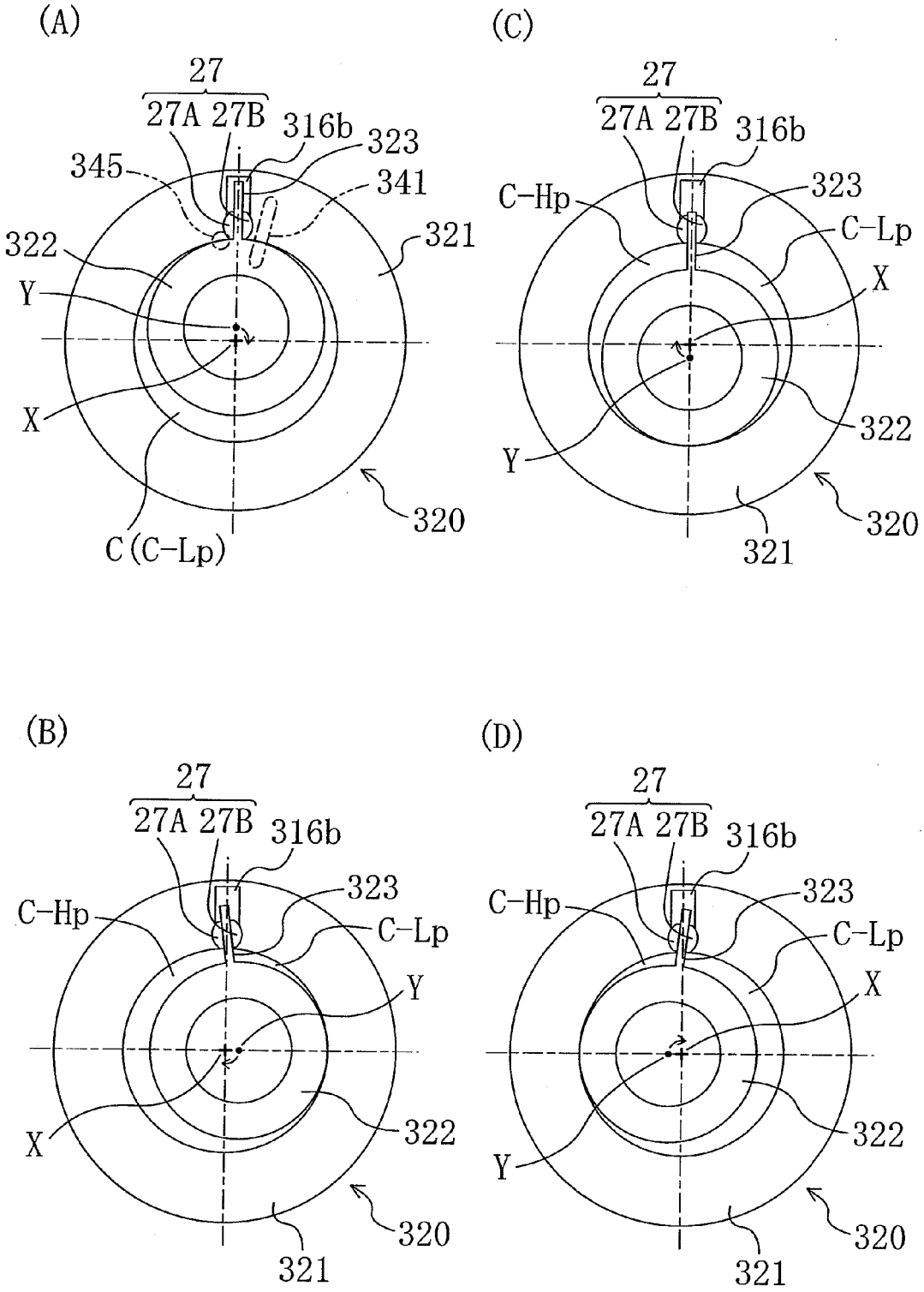
FIG. 9 illustrates schematic explanatory drawings showing an operation of a compression mechanism.

The blade (323) is integrally formed with the circular piston (322) to extend radially from the outer peripheral face of the circular piston (322), as shown in FIG. 9. The blade (323) is supported by the cylinder (321) through the swing bush (27). Accordingly, the compression mechanism (320) in the present example embodiment is of swing type. The blade (323) and the swing bush (27) serve as a movable member support part.

A suction port (341) is formed below the suction pipe (14) in the upper housing (316). The suction port (341) passes through the upper housing (316) in the axial direction to allow the low pressure chamber (C-Lp) of the cylinder chamber (C) to communicate with the space (the low pressure space (S1)) above the upper housing (316).

A discharge port (345) is formed in the upper housing (316). The discharge port (345) passes through the upper housing (316) in the axial direction. The lower end of the discharge port (345) opens to the high pressure chamber (C-Hp) of the cylinder chamber (C). On the other hand, the upper end of the discharge port (345) communicates with the discharge space (49) through the discharge valve (the reed valve) (47) opening/closing the discharge port (345).

The discharge space (49) is formed between the upper housing (316) and the cover plate (18). In the upper housing (316) and the lower housing (317), discharge path (49*a*) is formed to allow the space (the high pressure space (S2)) below the lower housing (317) to communicate with the discharge space (49).

A support plate (355) is provided below the lower housing (317) in the casing (10). The support plate (355) is a substantially disk-shaped plate having a side edge fixed to the inner peripheral surface of the casing (10). Between the support plate (355) and the lower housing (317), a second eccentric part (333*b*) of the drive shaft (333) is located, and a reverse moment generating mechanism (350) is disposed.

The reverse moment generating mechanism (350) includes a revolution body (351) provided at the second eccentric part (333*b*) of the drive shaft (333), and a pin (353) supporting the revolution body (351).

Figure 10:
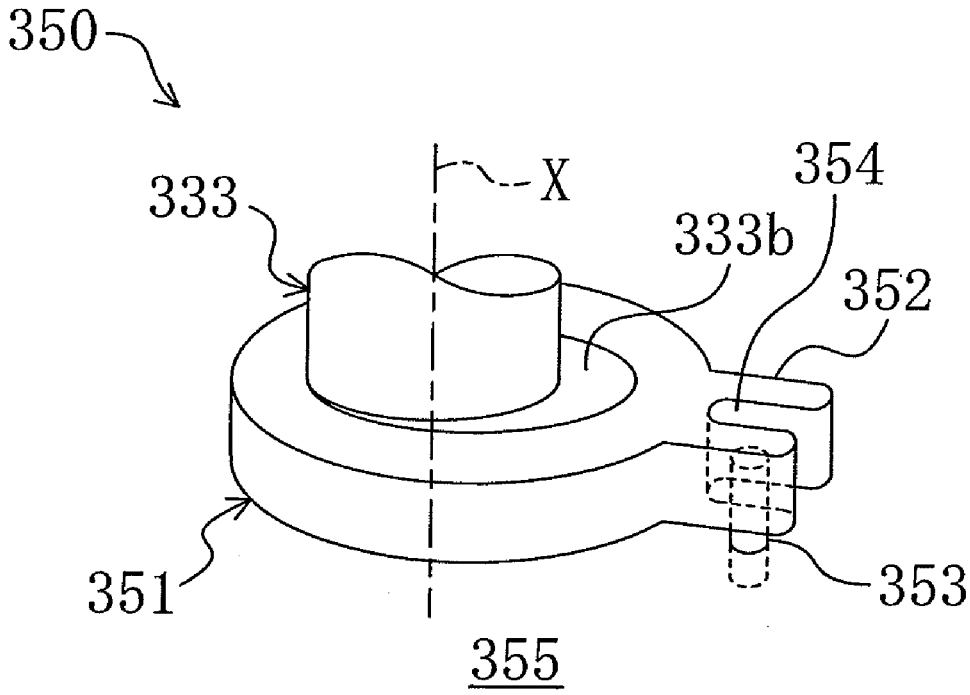
FIG. 10 is a perspective view showing a configuration of a reverse moment generating mechanism.
Figure 11:
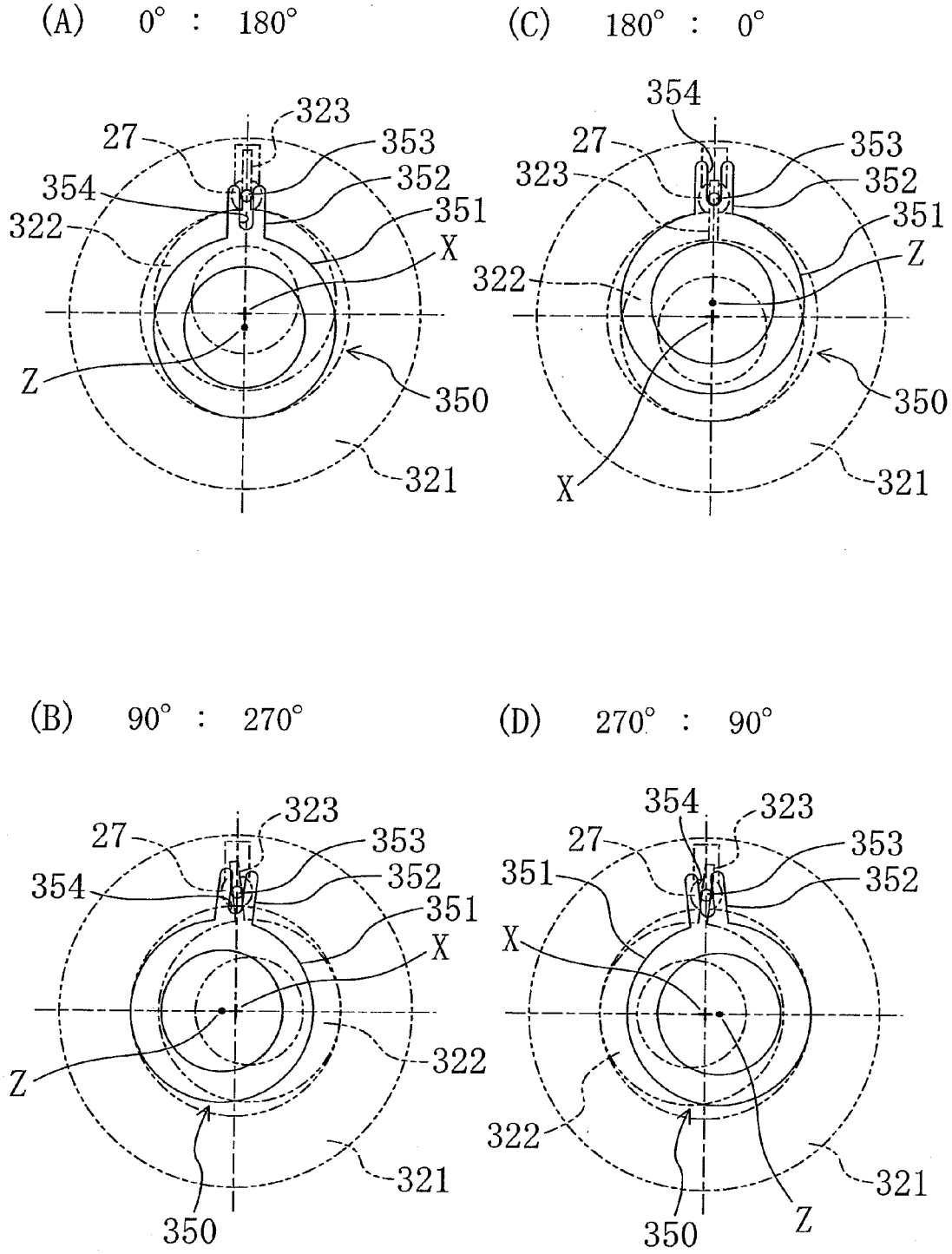
FIG. 11 illustrates schematic explanatory drawings showing an operation of the reverse moment generating mechanism.

The revolution body (351) is an annular member, as shown in FIGS. 10 and 11, and is fitted rotatably to the second eccentric part (333*b*) of the drive shaft (333). A protrusion (352) is formed at the revolution body (351) to protrude outward in the radial direction. A notch (354) is formed in the protrusion (352) to extend inward in the radial direction of the revolution body (351) from the tip end of the protrusion (352). The notch (354) has a predetermined width, and extends linearly in the radial direction of the revolution body (351). The pin (353) and the notch (354) serve as a revolution body support part, and the notch (354) serves as a guide part.

On the other hand, the pin (353) stands at a point of the support plate (355) of which angular position about the rotation axis (X) of the drive shaft (333) is the same as that of the swing bush (27). The pin (353) is a single column-shaped cylindrical pin. The outer diameter of the pin (353) is slightly smaller than the width of the notch (354). A hole for receiving the pin (353) is formed in the support plate (355) in advance. The base end of the pin (353) is pressure inserted in the hole. That is, the pin (353) is fixed to the support plate (355) to be prevented from relative movement to the support plate (355). The pin (353) is fitted in the notch (354) of the revolution body (351). In other words, the revolution body (351) can freely move back and forth along the longitudinal direction of the notch (354) and can freely turn about the pin (353) as a center.

—Driving Operation—

A driving operation of the compressor (301) will be described next.

When the motor (30) starts, the rotation of the rotor (32) is transmitted to the circular piston (322) of the compression mechanism (320) through the drive shaft (333). Then, the circular piston (322) revolves while swinging with respect to the cylinder (321) to cause the compression mechanism (320) to perform a predetermined compression operation. In this time, the blade (323) moves back and forth (reciprocates) between the bushes (27A, 27B), and swings integrally with the swing bushes (27A, 27B) with respect to the cylinder (321).

Specifically, the circular piston (322) revolves, as shown in FIG. 9. Suppose that the revolution angle of the circular piston (322) is zero degree when the swing center of the swing bush (27) and the axial center (Y) of the circular piston (322) (the axial center of the first eccentric part (333*a*)) are aligned on a straight line radially extending from the rotation axis (X) of the drive shaft (333) in a plan view (or, when the axial center (Y) of the circular piston (322) is located on a line segment connecting the rotation axis (X) to the swing bush (27)). FIG. 9(A) shows the state where the revolution angle of the circular cylinder (322) is zero degree or 360 degrees. FIG. 9(B) shows the state where it is 90 degrees. FIG. 9(C) shows the state where it is 180 degrees. FIG. 9(D) shows the state where it is 270 degrees.

In the cylinder chamber (C), the volume of the low pressure chamber (C-Lp) is almost zero in the state shown in FIG. 9(A). When the drive shaft (333) rotates clockwise in the drawing from this state to the state shown in FIG. 9(B), the low pressure chamber (C-Lp) is formed. As the state proceeds from this state to the states shown in FIG. 9(C), to FIG. 9(D), then to FIG. 9(A), the volume of the low pressure (C-Lp) increases, so that the refrigerant is sucked into the low pressure chamber (C-Lp) through the suction pipe (14), the low pressure space (S1), and the suction port (341).

When the drive shaft (333) makes one rotation to be in the state shown in FIG. 9(A) again, the refrigerant suction to the low pressure chamber (C-Lp) terminates. Then, the low pressure chamber (C-Lp) becomes the high pressure chamber (C-Hp) next for compressing the refrigerant, and a new low pressure chamber (C-Lp) isolated by the blade (323) is formed. When the drive shaft (333) further rotates, the refrigerant suction is repeated in the low pressure chamber (C-Lp), while the volume of the high pressure chamber (C-Hp) decreases to compress the refrigerant in the high pressure chamber (C-Hp). When the pressure of the high pressure chamber (C-Hp) becomes a predetermined value, and the pressure difference from the discharge space (49) reaches a set value, the high pressure refrigerant in the high pressure chamber (C-Hp) opens the discharge valve (48) to flow from the discharge space (49) to the space between the lower housing (317) and the support plate (355) through the discharge path (49*a*), and then to flow into the high pressure space (S2) through a communication hole (not shown) formed in the support plate (355).

In this way, during the time when the revolution of the circular piston (322) compresses the refrigerant, since the blade (323) is in engagement with the swing bush (27), the circular piston (322) rotates so that the blade (323) is directed at the swing bush (27). That is, the rotation of the circular piston (322) is limited so that the blade (323) is directed at the swing bush (27), and the rotation speed and direction of the circular piston (322) change according to the relative positional relationship between the circular piston (322) and the swing bush (27). Thus, the rotation moment is generated at the circular piston (322). Since the rotation of the circular piston (322) is limited by the swing bush (27), the reaction force against the rotation moment of the circular piston (322) acts on the swing bush (27). As a result, the moment caused by the reaction force about the rotation axis (X) acts on compressor (301). Also, a load acts on the first eccentric part (333*a*) by the rotation moment of the circular piston (322). As a result, moment caused by the load to the first eccentric part (333*a*) acts on the drive shaft (333) at which the first eccentric part (333*a*) is provided. However, the reverse moment generating mechanism (350) works to cancel the moment caused by the rotation including the moment caused by the reaction force and the moment caused by the load.

Herein, an operation of the reverse moment generating mechanism (350) will be described in detail with reference to FIG. 11.

Suppose herein that the revolution angle of the revolution body (351) is zero degree when the pin (353) and the axial center (Z) of the revolution body (351) (the axial center of the second eccentric part (333*b*)) are aligned on a straight line radially extending from the rotation axis (X) of the drive shaft (333) in a plan view (or, when the axial center (Z) of the revolution body (351) is located on a line segment connecting the rotation axis (X) to the pin (353)). In each of FIGS. 11(A)

to 11(D), the values of the revolution angles of the circular piston (322) and the revolution body (351) are indicated first and second, respectively. In the present example embodiment, the circular piston (322) is eccentric on the opposite side of the rotation axis (X) to the revolution body (351), and the angular position of the swing bush (27) about the rotation axis (X) determining the reference point of the revolution angle of the circular piston (322) agrees with that of the pin (353) and that of the notch (354) about the rotation axis (X) determining the reference point of the revolution angle of the revolution body (351). Accordingly, the revolution angle of the circular piston (322) is shifted by 180 degrees from that of the revolution body (351).

First, as shown in FIG. 11(A), when the revolution angle of the circular piston (322) is zero degree, the circular piston (322) is located at the twelve o'clock position with respect to the rotation axis (X), while the revolution body (351) is located at the six o'clock position with respect to the rotation axis (X). That is, the phase of the revolution body (351) is consistently shifted by 180 degrees from that of the circular piston (322) with respect to the rotation axis (X).

When the drive shaft (333) rotates clockwise from the above state, as shown in FIG. 11(B), the circular piston (322) revolves clockwise to the three o'clock position with respect to the rotation axis (X), while the revolution body (351) revolves clockwise to the nine o'clock position with respect to the rotation axis (X). In this time, the circular piston (322) revolves while rotating counterclockwise so that the blade (323) is directed at the swing bush (27). The rotation speed of this rotation decreases as the revolution angle of the circular piston (322) increases from zero degree. When the revolution angle is substantially 90 degrees (specifically, when the swing angle of the circular piston (322) in one direction about the swing bush (27) as a center is maximum), the rotation speed becomes zero. Thereafter, the rotation direction is switched. Referring to the revolution body (351), it revolves while rotating so that the notch (354) of the protrusion (352) is directed at the pin (353). The circular piston (322) is eccentric on the opposite side of the rotation axis (X) to the revolution body (351), and the angular position about the rotation axis (X) of the swing bush (27) as the swing center of the circular piston (322) agrees with that of the pin (353) and that of the notch (354) as the swing center of the revolution body (351). Therefore, the rotation direction of the revolution body (351) is the counterclockwise direction reverse to the rotation direction of the circular piston (322). The rotation speed of this rotation decreases as the revolution angle of the revolution body (351) increases from 180 degrees. When the revolution angle is substantially 270 degrees, (specifically, when the swing angle of the revolution body (351) in the other direction about the pin (353) as a center is maximum), the rotation speed becomes zero. Thereafter, the rotation direction is switched.

When the drive shaft (333) further rotates clockwise thereafter, as shown in FIGS. 11(C) and 11(D), the circular piston (322) revolves clockwise from the three o'clock position to the six o'clock position, then to the nine o'clock position with respect to the rotation axis (X), while the revolution body (351) revolves clockwise from the nine o'clock position to the twelve o'clock position, then to the three o'clock position with respect to the rotation axis (X). In this time, the circular piston (322) rotates clockwise so that the blade (323) is directed at the swing bush (27). The rotation speed of this rotation increases as the revolution angle of the circular piston (322) increases from 90 degrees. When the revolution angle becomes 180 degrees, the rotation speed becomes maximum. The rotation speed decreases as the revolution angle increases from 180 degrees. When the revolution angle becomes substantially 270 degrees (specifically, when the swing angle of the circular piston (322) in the other direction about the swing bush (27) as a center is maximum), the rotation speed becomes zero. Thereafter, the rotation direction is switched. Referring to the revolution body (351), it rotates counterclockwise so that the notch (354) is directed at the pin (353). The rotation speed of this rotation increases as the revolution angle of the revolution body (351) increases from 270 degrees. When the revolution angle becomes 360 degrees (zero degree), the rotation speed becomes maximum. The rotation speed decreases as the revolution angle increases from zero degree. When the revolution angle becomes substantially 90 degrees (specifically, when the swing angle of revolution body (351) in the one direction about the pin (353) as a center is maximum), the rotation speed becomes zero. Thereafter, the rotation direction is switched.

When the drive shaft (333) further rotates clockwise from the above state, as shown in FIG. 11(A), the circular piston (322) revolves clockwise from the nine o'clock position to the twelve o'clock position with respect to the rotation axis (X), while the revolution body (351) revolves clockwise from the three o'clock position to the six o'clock position with respect to the rotation axis (X). In this time, the circular piston (322) rotates counterclockwise so that the blade (323) is directed at the swing bush (27). The rotation speed of this rotation increases as the revolution angle of the circular piston (322) increases from 270 degrees. When the revolution angle becomes 360 degrees (zero degree), the rotation speed becomes maximum. Referring to the revolution body (351), it rotates clockwise so that the notch (354) is directed at the pin (353). The rotation speed of this rotation increases as the revolution angle of the revolution body (351) increases from 90 degrees. When the revolution angle becomes substantially 180 degrees, the rotation speed becomes maximum.

In this way, when the circular piston (322) makes one revolution about the rotation axis (X), the revolution body (351) also makes one revolution about the rotation axis (X). Here, the revolution body (351) and the circular piston (322) rotate in the reverse directions to each other, as described above. As the rotation speed of the circular piston (322) increases, the rotation speed of the revolution body (351) (in the reverse direction) increases also. In reverse, as the rotation speed of the circular piston (322) decreases, the rotation speed of the revolution body (351) (in the reverse direction) also decreases. As a result, rotation moment having a center at the first eccentric part (333*a*) is generated at the circular piston (322), while rotation moment having a center at the second eccentric center (33*b*), which is in the reverse direction to that of the rotation moment of the circular piston (322), is generated at the revolution body (351).

The rotation of the circular piston (322) is limited by the swing bush (27), as described above, and therefore, the reaction force against the rotation moment acts on the swing bush (27). This reaction force acts on the compressor (301) as moment about the rotation axis (X), namely, moment caused by the reaction force. On the other hand, the rotation of the revolution body (351) is also limited by the pin (353), so that the reaction force against the rotation moment acts on the pin (353). This reaction force acts on the compressor (301) as moment caused by the reaction force about the rotation axis (X). Since the rotation direction of the circular piston (322) is reverse to that of the revolution body (351), the direction of the reaction force against the rotation moment acting on the swing bush (27) is reverse to that of the reaction force against the rotation moment acting on the pin (353). In other words, the moment caused by the reaction force of the circular piston (322) and that of the revolution body (351) act in the directions canceling each other about the rotation axis (X).

Further, as described above, the circular piston (322) is mounted at the first eccentric part (333*a*), and therefore, a load acts on the first eccentric part (333*a*) by the rotation moment of the circular piston (322). This load acts on the drive shaft (333) through the first eccentric part (333*a*) as moment about the rotation axis (X), namely, moment caused by the load. On the other hand, the revolution body (351) is mounted at the second eccentric part (333*b*), and therefore, a load acts on the second eccentric part (333*b*) by the rotation moment of the revolution body (351). This load acts on the drive shaft (333) through the second eccentric part (333*b*) as moment caused by the load about the rotation axis (X). Since the rotation direction of the circular piston (322) is reverse to that of the revolution body (351), the moment caused by the load of the circular piston (322) and the moment caused by the load of the revolution body (351), which act on the drive shaft (333), act in the directions canceling each other about the rotation axis (X).

Thus, the moment caused by the rotation of the circular piston (322) and the moment caused by the rotation of the revolution body (351) cancel each other, thereby suppressing vibration of the compressor (301).

Advantages of Example Embodiment 3

Thus, in Example Embodiment 3, the revolution body (351) is eccentric on the opposite side of the rotation axis (X) of the drive shaft (33) to the circular piston (322), and the pin (353) supporting the revolution body (351) is arranged at the same angular position about the rotation axis (X) as the swing bush (27) supporting the circular piston (322). This causes the moment caused by the rotation of the circular piston (322) acting about the rotation axis (X) to be cancelled by the moment caused by the rotation of the revolution body (351) in the reverse direction, thereby reducing vibration of the compressor (301).

Example Embodiment 4

A compressor in accordance with Example Embodiment 4 is a scroll compressor in which a fixed scroll and an orbiting scroll form a fluid chamber, which is the difference from Example Embodiments 1 to 3 in which the cylinder(s) and the piston form the fluid chamber(s).

Figure 12:
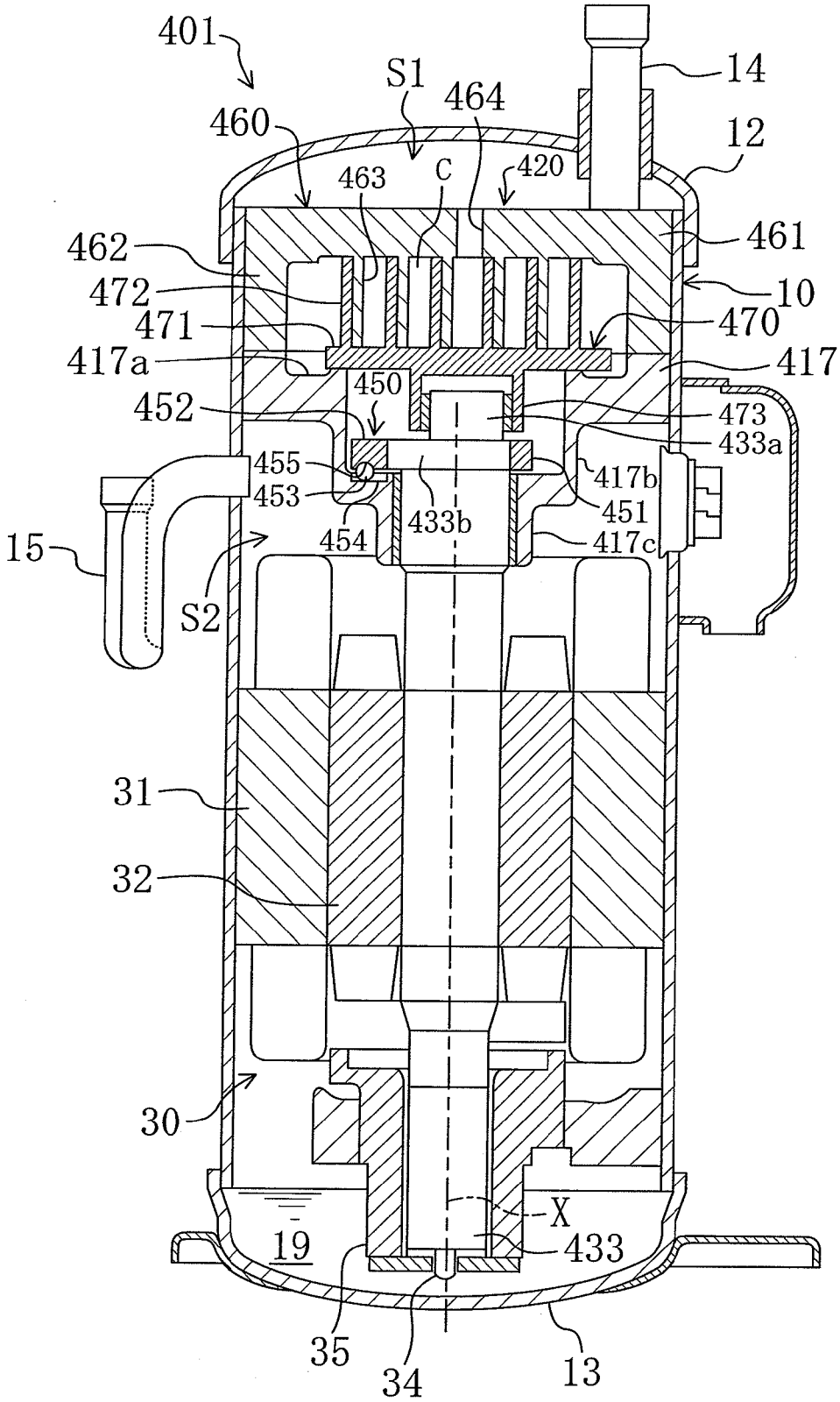
FIG. 12 is a vertical cross-section of a compressor in accordance with Example Embodiment 4 of the present invention.

Specifically, as shown in FIG. 12, a compressor (401) is of hermetic type. The compressor (401) includes a vertically long, cylindrical, and hermetic casing (10). Inside the casing (10), there are arranged a lower bearing part (35), the motor (30), and a compression mechanism (420) in this order from the bottom to the top. Further, a vertically extending drive shaft (433) is disposed inside the casing (10).

The suction pipe (14) is mounted at the top of the casing (10). The terminal end of the suction pipe (14) is connected to the compression mechanism (420). While on the other hand, a discharge pipe (15) is mounted at the body part (11) of the casing (10). The terminal end of the discharge pipe (15) opens between the motor (30) and the compression mechanism (420) in the casing (10).

The motor (30) includes the stator (31) and the rotor (32). The stator (31) is disposed below the compression mechanism (420), and is fixed to the body part (11) of the casing (10). The drive shaft (433) is connected to the rotor (32), and is configured to rotate together with the rotor (32) about the rotation axis (X).

The drive shaft (433) includes a first eccentric part (433*a*) eccentric with respect to the rotation axis (X), and a second eccentric part (433*b*) formed below the first eccentric part (433*a*). The second eccentric part (433*b*) is eccentric on the opposite side of the rotation axis (X) to the first eccentric part (433*a*).

Further, the oil supply path (not shown) is provided to axially extend inside the drive shaft (433). The oil supply pump (34) is provided at the lower end of the drive shaft (433). The oil supply path extends from the oil supply pump (34) upward to the compression mechanism (420). With this configuration, the oil supply pump (34) supplies lubricant oil retained in the oil retainer (19) in the high pressure space (S2), which will be described later, in the casing (10) to the sliding parts of the compression mechanism (420) through the oil supply path.

The lower bearing part (35) is fixed at the vicinity of the lower end of the body part of the casing (10). A sleeve bearing is formed in the central part of the lower bearing part (35) to rotatably support the lower end of the drive shaft (433).

The compression mechanism (420) includes a fixed scroll (460), an orbiting scroll (470), and a housing (417). In the compression mechanism (420), a fixed side wrap (463) of the fixed scroll (460) are in engagement with an orbiting side wrap (472) of the orbiting scroll (470) to form the compression chambers (C) as fluid chambers. The fixed scroll (460) serves as a fixed member, while the orbiting scroll (470) serves as a movable member.

Figure 13:
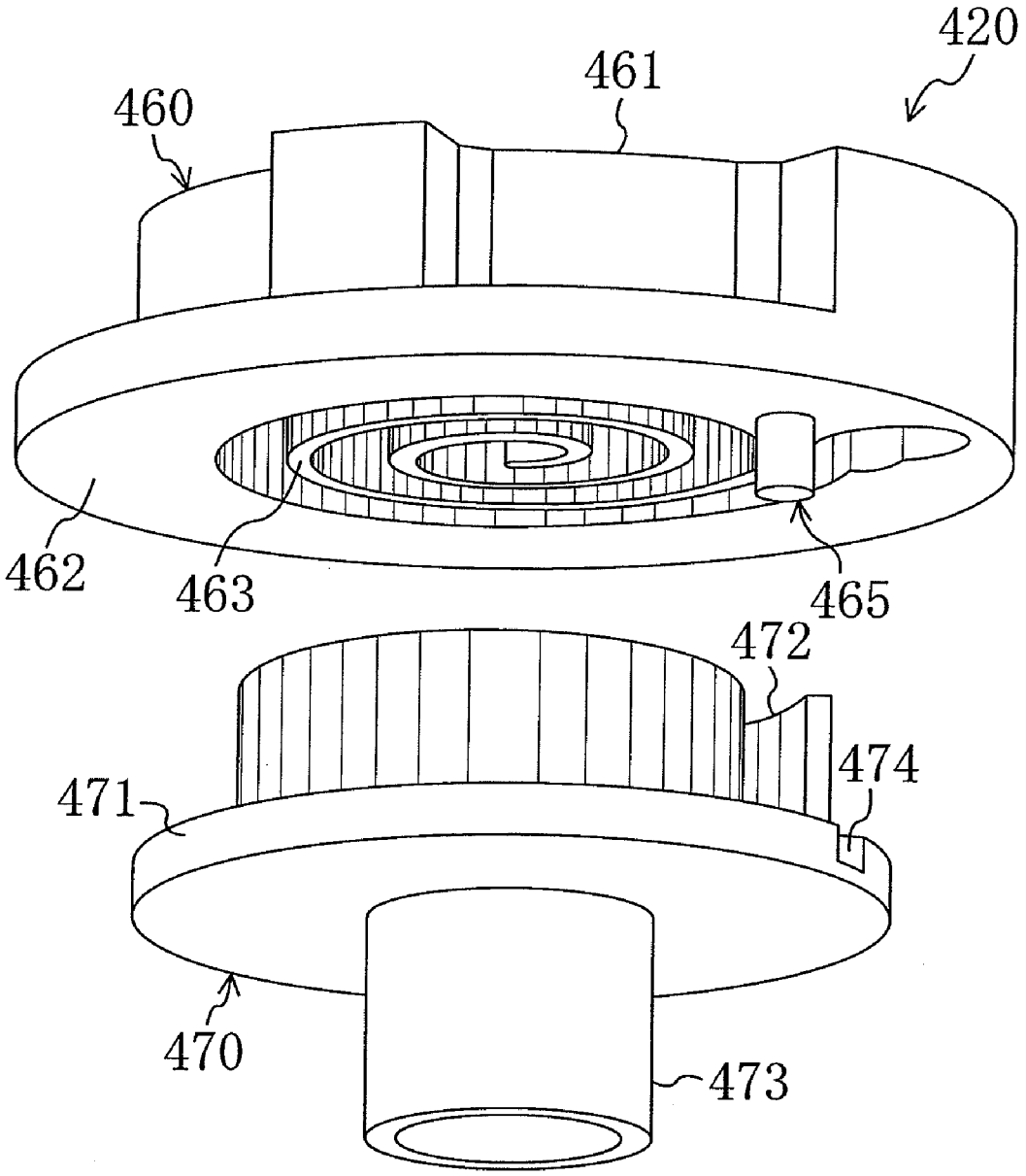
FIG. 13 is a perspective view of a fixed scroll and an orbiting scroll as viewed from obliquely below.
Figure 14:
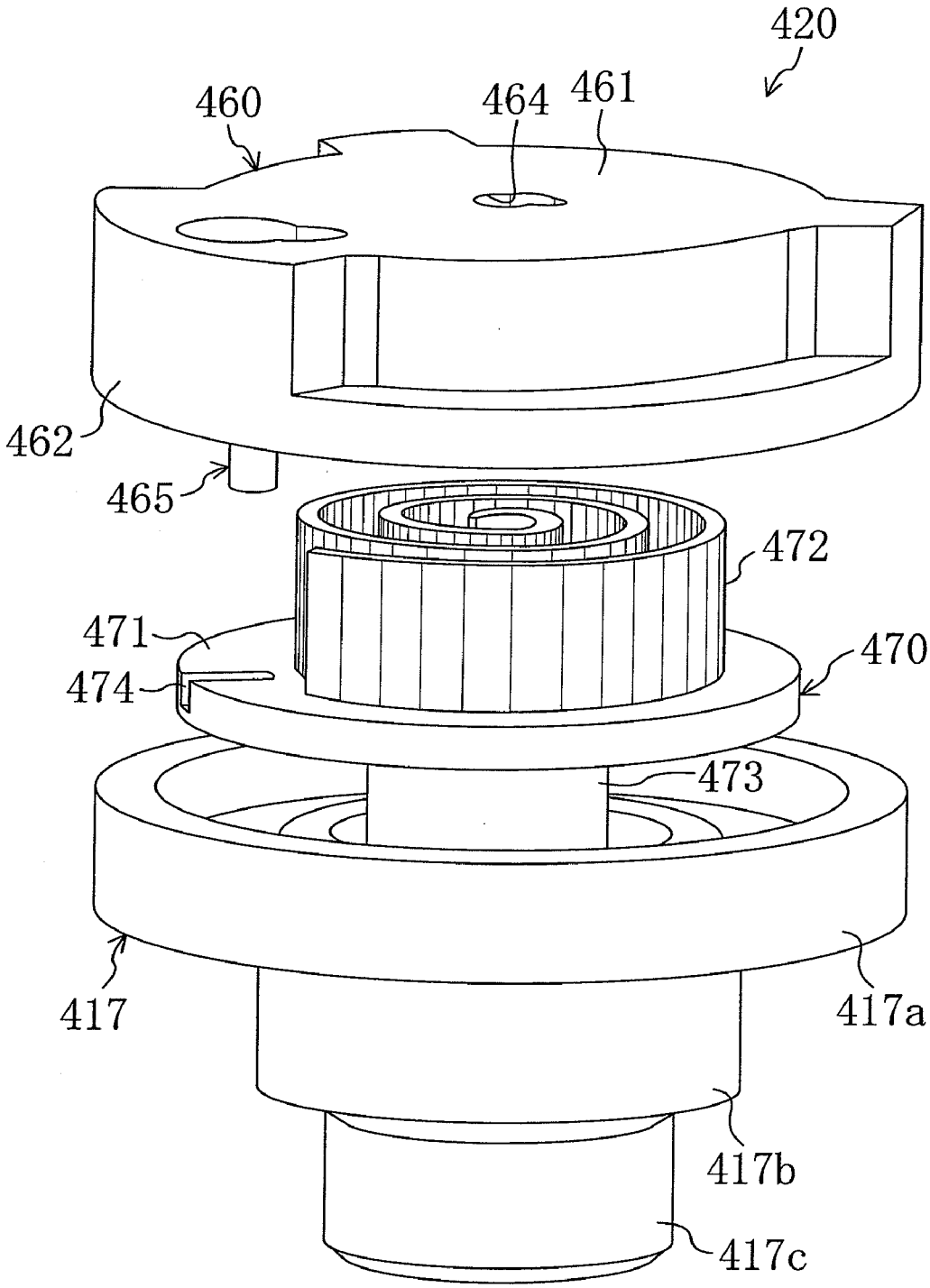
FIG. 14 is a perspective view of the fixed scroll and the orbiting scroll as viewed from obliquely above.

The orbiting scroll (470) includes, as shown in FIGS. 13 and 14, an orbiting side end plate (471), the orbiting side wrap (472), and a protruding cylindrical portion (473).

The orbiting side end plate (471) is in a disk shape. In the orbiting side end plate (471), the orbiting side wrap (472) protrudes from the front surface thereof (the surface facing the fixed scroll (460)), while the protruding cylindrical portion (473) protrudes from the back surface thereof (the surface facing the housing (417)). A slide groove (474) is formed in the orbiting side end plate (471).

The orbiting side wrap (472) is formed integrally with the orbiting side end plate (471). The orbiting side wrap (472) is in a scroll wall shape having a predetermined height.

The protruding cylindrical portion (473) is in a cylindrical shape, and is arranged nearly at the center on the back surface of the orbiting side end plate (471). The first eccentric part (433*a*) of the drive shaft (433) is rotatably fitted in the protruding cylindrical portion (473). In other words, the first eccentric part (433*a*) of the drive shaft (433) is in engagement with the orbiting scroll (470). When the drive shaft (433) rotates, the orbiting scroll (470) engaging with the first eccentric part (433*a*) revolves about the rotation axis (X) as a center. The revolution radius of the orbiting scroll (470) agrees with the distance between the axial center of the first eccentric part (433*a*) and the rotation axis (X) of the drive shaft (433), that is, the amount of eccentricity of the first eccentric part (433*a*).

The slide groove (474) is formed in the vicinity of the outer peripheral side end of the orbiting side wrap (427). Specifically, the slide groove (472) is formed at a point advanced along the scrolling direction of the orbiting side wrap (472) from the outer peripheral side end. The slide groove (474) is a straight grove having a predetermined width, and extends nearly in the radial direction of the orbiting side end plate (471). The slide groove (474) opens at not only the front surface but also the outer peripheral surface of the orbiting side end plate (471). That is, the slide groove (474) is a bottomed groove not passing through the orbiting side end plate (471), and does not open at the back surface of the orbiting side end plate (471).

The fixed scroll (460) is fixed to the body part of the casing (10). The fixed scroll (460) includes a fixed side end plate (461), a peripheral wall (462), and the fixed side wrap (463). A pin (465) is formed at the fixed scroll (460).

The fixed side end plate (461) is in a disk shape. The discharge port (464) is formed to pass through the central part of the fixed side end late (461).

The peripheral wall (462) is formed in a wall shape extending downward from the periphery of the fixed side end plate (461). The lower end of the peripheral wall (462) protrudes outward around the entire periphery thereof. The peripheral wall (462) has three portions around the periphery thereof which protrude outward.

The fixed side wrap (463) stands on the lower surface of the fixed side end plate (461), and is integrated with the fixed side end plate (461). The fixed side wrap (463) is in a scroll wall shape having a predetermined height.

The pin (465) is provided to protrude from the lower surface of the peripheral wall (462) at a point corresponding to the slide groove (474) of the orbiting scroll (470). The pin (465) is a single column-shaped cylindrical pin. The outer diameter of the pin (465) is slightly smaller than the width of the slide groove (474). A hole for receiving the pin (465) is formed in the peripheral wall (462) in advance, and the base end (the upper end in FIGS. 13 and 14) of the pin (465) is pressure inserted in the hole. In other words, the pin (465) is fixed to the fixed scroll (460) to be prevented from relative movement to the fixed scroll (460). On the other hand, the tip end (the lower end in FIGS. 13 and 14) of the pin (465) is fitted in the slide grove (474) of the orbiting scroll (470). The pin (465) and the slide groove (474) serve as a movable member support part.

The housing (417) is fixed to the body part of the casing (10). The housing (417) includes an upper part (417*a*), a middle part (417*b*), and a lower part (417*c*). The upper part (417*a*) is in a dish shape. The middle part (417*b*) is in a cylindrical shape having a diameter smaller than that of the upper part (417*a*), and protrudes downward from the lower surface of the upper part (417*a*). The lower part (417*c*) is formed in a cylindrical shape having a diameter smaller than the middle part (417*b*), and protrudes downward from the lower surface of the middle part (417*b*). The drive shaft (433) is inserted in the lower part (417*c*), and the lower part (417*c*) serves as a sleeve bearing supporting the drive shaft (433). The first and second eccentric parts (433*a*, 433*b*) of the drive shaft (433) are disposed inside the middle part (417*b*).

In the thus structured compression mechanism (420), the orbiting scroll (470) is accommodated in a space surrounded by the fixed scroll (460) and the housing (417). The orbiting scroll (470) is placed on the upper part (417*a*) of the housing (417). The back surface of the orbiting side end plate (417) slides on the bottom surface of the upper part (417*a*).

As described above, the orbiting side wrap (472) and the fixed side wrap (463) are formed in scroll wall shapes. The scroll compressor (401) employs a so-called asymmetric scroll structure, in which the numbers of windings are different between the fixed side wrap (463) and the orbiting side wrap (472). Specifically, the fixed side wrap (463) is longer by about ½ winding than the orbiting side wrap (472). The outer peripheral side end of the fixed side wrap (463) is located in the vicinity of the outer peripheral side end of the orbiting side wrap (472). The outermost peripheral part of the fixed side wrap (463) is integrated with the peripheral wall (462).

Figure 15:
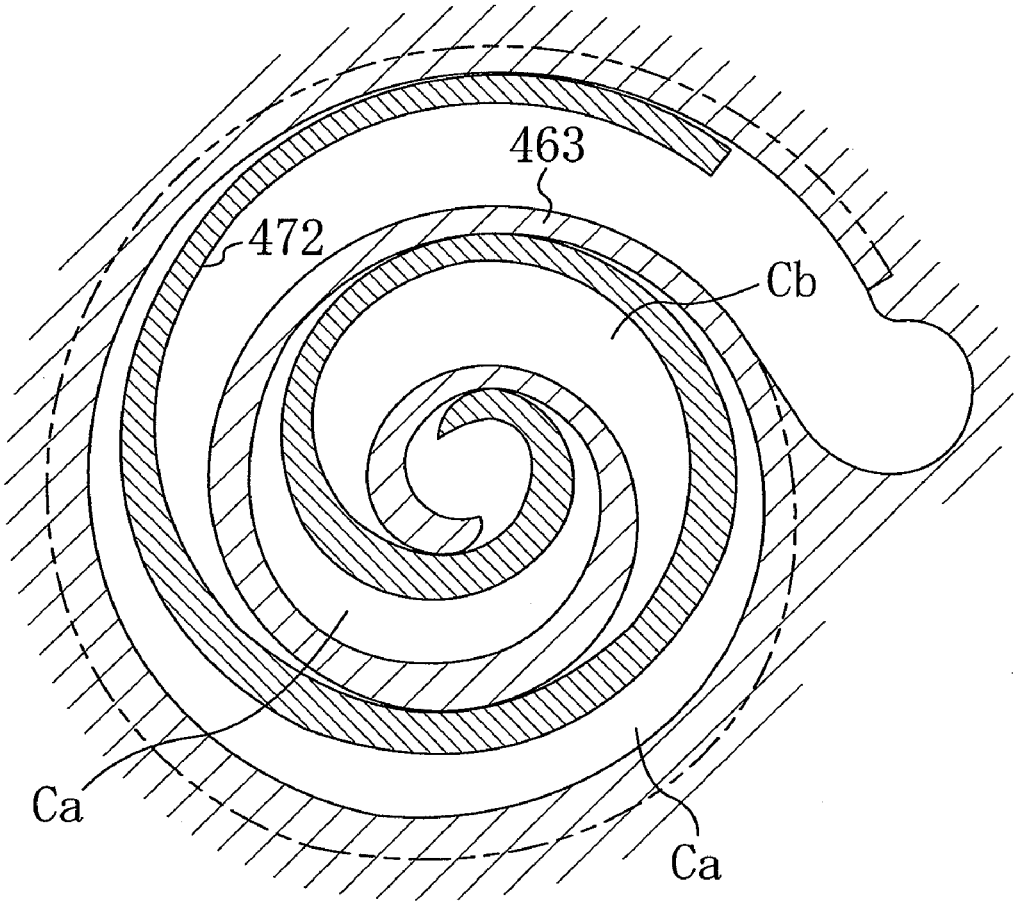
FIG. 15 is a transverse cross-section of a compression mechanism.

The orbiting side wrap (472) is in engagement with the fixed side wrap (463), as shown in FIG. 15, to form a plurality of compression chambers (C). Of the plural compression chambers (C), a chamber facing the outside surface (outside wrap surface) of the orbiting side wrap (472) serves as A chambers (Ca), while a chamber facing the inside surface (inside wrap surface) of the orbiting side wrap (472) serves as B chambers (Cb). In the present example embodiment, since the number of windings of the fixed side wrap (463) is larger than that of the orbiting side wrap (472), the maximum volume of the A chambers (Ca) is larger than that of the B chambers (Cb).

In contrast to a general scroll compressor employing an Oldham ring mechanism or the like, in which the rotation of the orbiting scroll is prevented completely, the rotation of the orbiting scroll (470) of the scroll compressor (401) in the present example embodiment is allowed to some extent, as will be described later.

In view of this, the thicknesses of the orbiting side wrap (472) and the fixed side wrap (463) are changed to bring the shape of the orbiting side wrap (472) and the fixed side wrap (463) into agreement with the movement of the orbiting scroll (470). Specifically, the inside and outside surfaces of the orbiting side wrap (472) and the inside and outside surfaces of the fixed side wrap (463), namely, all the wrap surfaces are in shapes different from those in a general scroll type fluid machinery. In the orbiting side wrap (472), parts of which thickness gradually increases and parts of which thickness gradually decreases are formed alternately from its inner peripheral side end toward its outer peripheral side end. In the fixed side wrap (463), parts of which thickness gradually increases and parts of which thickness gradually decreases are formed alternately from the inner peripheral side end toward the outer peripheral side end. The inside surface of the fixed side wrap (463) serves as an envelop surface of the outside surface of the orbiting side wrap (472), while the outside surface thereof serves as an envelope surface of the inside surface of the orbiting side wrap (472).

In the middle part (417*b*) of the housing (417), a reverse moment generating mechanism (450) is disposed. The reverse moment generating mechanism (450) includes a revolution body (451) arranged at the second eccentric part (433*b*) of the drive shaft (433), and a slide groove (454) supporting the revolution body (451).

The revolution body (451) is an annular member, and is rotatably fitted to the second eccentric part (433*b*) of the drive shaft (433). At the revolution body (451), a protrusion (452) is formed to protrude outward in the radial direction. A spherically recessed concave (455) is formed in the lower surface (the surface on the side opposed to the housing (417)) of the protrusion (452). A ball (453) is slidably fitted in the concave (455).

On the other hand, the slide groove (454) is formed in the upper surface (the surface on the side opposed to the revolution body (451)) of the bottom of the middle part (417*b*). Specifically, the slide groove (454) is formed at the same angular position about the rotation axis (X) as the concave (455). The slide groove (454) is a linear groove having a predetermined width, and extends nearly in the radial direction of the rotation axis (X). The slide groove (454) slidably receives the ball (453) of the revolution body (451). In other words, the revolution body (451) can move back and forth in the longitudinal direction of the slide groove (454), and can rotate about the ball (453) as a center. The ball (453) and the slide groove (454) serve as a revolution body support part.

—Driving Operation—

A driving operation of the compressor (401) will be described next.

When the motor (30) starts, the rotation of the rotor (32) is transmitted to the orbiting scroll (470) of the compression mechanism (420) through the drive shaft (433). Then, the orbiting scroll (470) revolves while swinging with respect to the fixed scroll (460) to allow the compression mechanism (420) to perform a predetermined compression operation.

Figure 16:
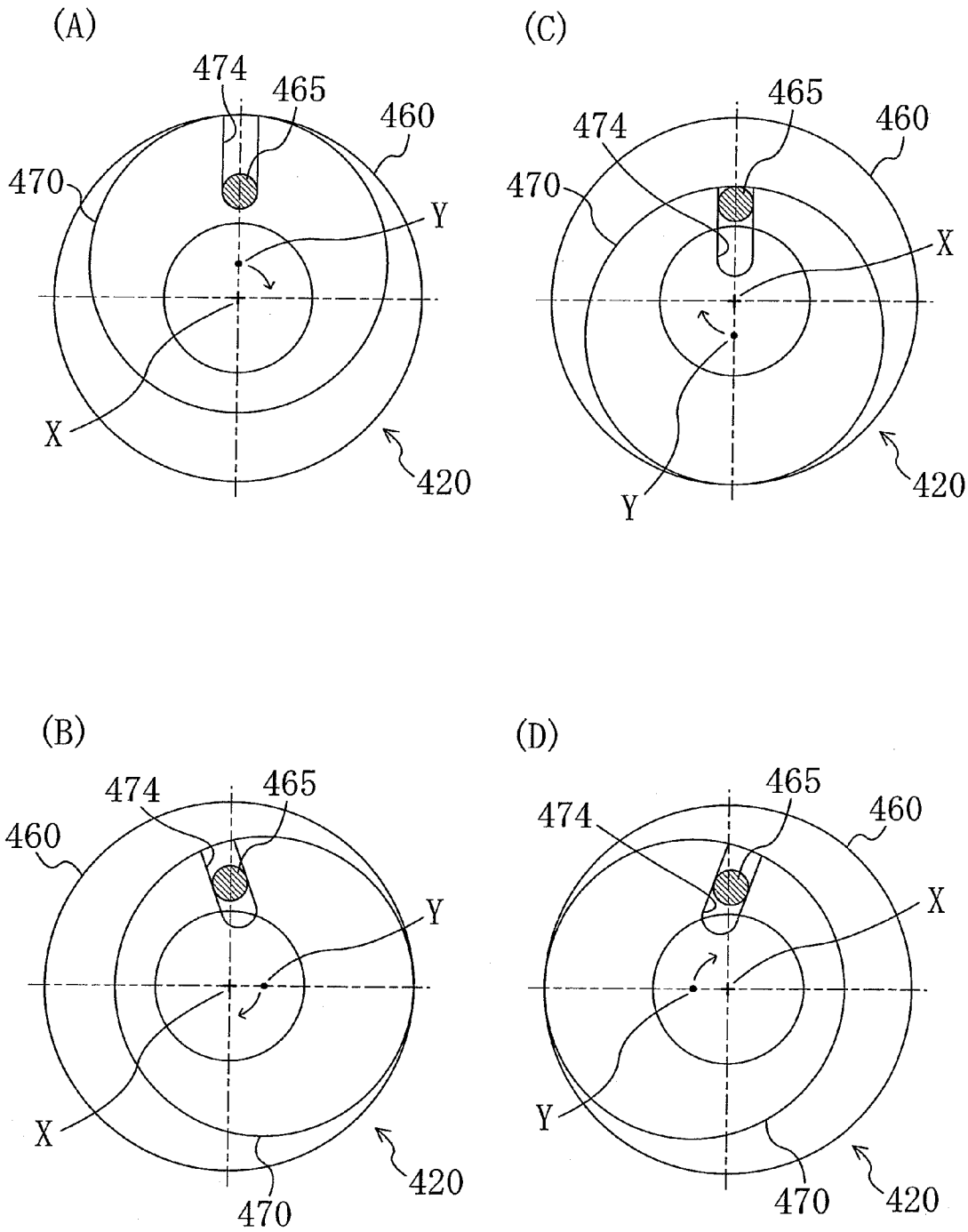
FIG. 16 is a schematic explanatory drawing showing an operation of the compression mechanism.

Specifically, as shown in FIG. 16, the orbiting scroll (470) revolves. Suppose that the revolution angle of the orbiting scroll (470) is zero degree when the pin (465) and the axial center (Y) of the orbiting scroll (470) (the axial center of the first eccentric part (433*a*)) are aligned on a straight line radially extending from the rotation axis (X) of the drive shaft (433) in a plan view (or, when the axial center (Y) of the orbiting scroll (470) is located on a line segment connecting the rotation axis (X) to the pin (465)). FIG. 16(A) shows the state where the revolution angle of the orbiting scroll (470) is zero degree or 360 degrees. FIG. 16(B) shows the state where it is 90 degrees. FIG. 16(C) shows the state where it is 180 degrees. FIG. 16(D) shows the state where it is 270 degrees.

When the drive shaft (433) rotates clockwise, the orbiting scroll (470) revolves about the rotation axis (X) as a center. When the revolution of the orbiting scroll (470) increases the volume of the compression chambers (C), low pressure gas refrigerant flows into the compression mechanism (420) through the suction pipe (14). The gas refrigerant is sucked from the outer peripheral sides of the orbiting side wrap (472) and the fixed side wrap (463) to the compression chambers (C). When the orbiting scroll (470) further revolves to decrease the volume of the compression chambers (C) in the closed state, the gas refrigerant in the compression chambers (C) is compressed. Then, the gas refrigerant compressed to be at high pressure is discharged into the space above the compression mechanism (420) through the discharge port (464). The gas refrigerant discharged from the compression mechanism (420) flows into the space below the compression mechanism (420) through a path not shown, and then, is discharged from the casing (10) through the discharge pipe (15).

Since the slide groove (474) of the orbiting scroll (470) is in engagement with the pin (465) of the fixed scroll (460), the orbiting scroll (470) moves back and forth in the longitudinal direction of the slide groove (474) while swinging about the pin (465) as a center. In other words, the rotation of the orbiting scroll (470) is limited in its revolution about the rotation axis (X) so that the slide groove (474) is directed at the pin (465). The rotation speed and direction of the orbiting scroll (470) change according to the relative positional relationship between the orbiting scroll (470) and the pin (465). Thus, rotation moment is generated at the orbiting scroll (470). Since the rotation of the orbiting scroll (470) is limited by the pin (465), the reaction force against the rotation moment of the orbiting scroll (470) acts on the pin (465). As a result, moment caused by the reaction force about the rotation axis (X) acts on the compressor (401). Also, a load acts on the first eccentric part (433*a*) by the rotation moment of the orbiting scroll (470). As a result, moment caused by the load to the first eccentric part (433*a*) acts on the drive shaft (433) at which the first eccentric part (433*a*) is provided. However, the moment caused by the rotation including the moment caused by the reaction force and the moment caused by the load is canceled by the reverse moment generating mechanism (450).

Figure 17:
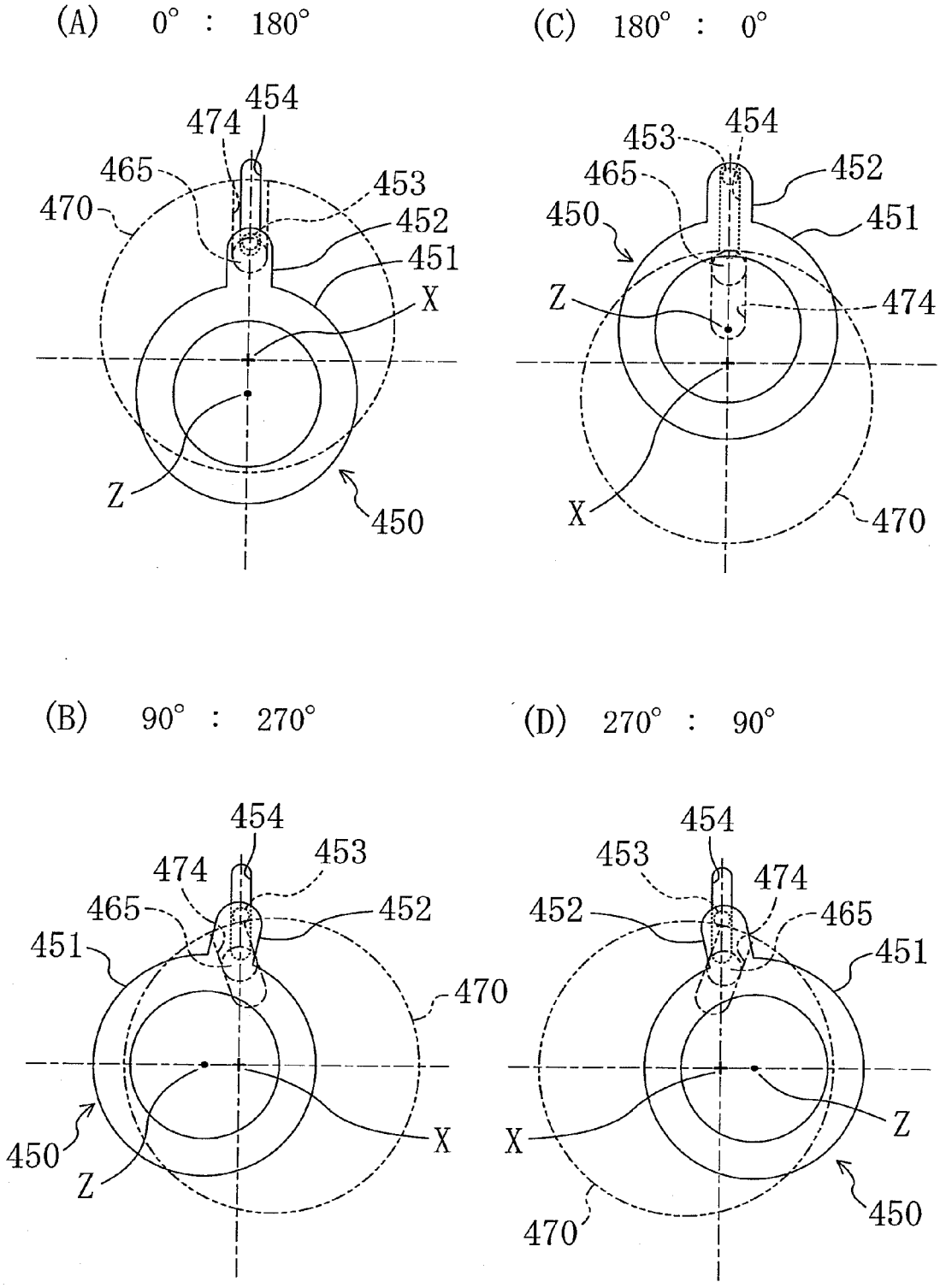
FIG. 17 illustrates schematic explanatory drawings showing an operation of a reverse moment generating mechanism.

Herein, an operation of the reverse moment generating mechanism (450) will be described in detail with reference to FIG. 17.

Suppose herein that the revolution angle of the revolution body (451) is zero degree when the ball (453) and the axial center (Z) of the revolution body (451) (the axial center of the second eccentric part (433*b*)) are aligned on a straight line radially extending from the rotation axis (X) of the drive shaft (433) in a plan view (or, when the axial center (Z) of the revolution body (451) is located on a line segment connecting the rotation axis (X) to the slide groove (454)). In each of FIGS. 17(A) to 17(D), the values of the revolution angles of the orbiting scroll (470) and the revolution body (451) are indicated first and second, respectively. In the present example embodiment, the orbiting scroll (470) is eccentric on the opposite side of the rotation axis (X) to the revolution body (451), and the angular position of the pin (465) about the rotation axis (X) determining the reference point of the revolution angle of the orbiting scroll (470) agrees with that of the ball (453) and that of the slide groove (454) about the rotation axis (X) determining the reference point of the revolution angle of the revolution body (451). Accordingly, the revolution angle of the orbiting scroll (470) is shifted by 180 degrees from that of the revolution body (451).

First, as shown in FIG. 17(A), when the revolution angle of the orbiting scroll (470) is zero degree, the orbiting scroll (470) is located at the twelve o'clock position with respect to the rotation axis (X), while the revolution body (451) is located at the six o'clock position with respect to the rotation axis (X). That is, the phase the revolution body (451) is consistently shifted by 180 degrees with respect to the rotation axis (X) from that of the orbiting scroll (470).

When the drive shaft (433) rotates clockwise from the above state, as shown in FIG. 17(B), the orbiting scroll (470) revolves clockwise to the three o'clock position with respect to the rotation axis (X), while the revolution body (451) revolves clockwise to the nine o'clock position with respect to the rotation axis (X). In this time, the orbiting scroll (470) revolves while rotating counterclockwise so that the slide groove (474) is directed at the pin (465). The rotation speed of this rotation decreases as the revolution angle of the orbiting scroll (470) increases from zero degree. When the revolution angle is substantially 90 degrees (specifically, when the swing angle of the orbiting scroll (470) in one direction about the pin (465) as a center is maximum), the rotation speed becomes zero. Thereafter, the rotation direction is switched. Referring to the revolution body (451), it revolves while rotating so that the concave (455) of the protrusion (452) is directed at the ball (453) fitted in the slide groove (454). The orbiting scroll (470) is eccentric on the opposite side of the rotation axis (X) to the revolution body (451), and the angular position of the pin (465) about the rotation axis (X) as the swing center of the orbiting scroll (470) agrees with that of the ball (453) and that of the slide groove (454) as the swing center of the revolution body (451). Therefore, the rotation direction of the revolution body (451) is the counterclockwise direction reverse to the rotation direction of the orbiting scroll (470). The rotation speed of this rotation decreases as the revolution angle of the revolution body (451) increases from 180 degrees. When the revolution angle is substantially 270 degrees, (specifically, when the swing angle of the revolution body (451) in the other direction about the ball (453) as a center is maximum), the rotation speed becomes zero. Thereafter, the rotation direction is switched.

When the drive shaft (433) further rotates clockwise thereafter, as shown in FIGS. 17(C) and 17(D), the orbiting scroll (470) revolves clockwise from the three o'clock position to the six o'clock position, then to the nine o'clock position with respect to the rotation axis (X), while the revolution body (451) revolves clockwise from the nine o'clock position to the twelve o'clock position, then to the three o'clock position with respect to the rotation axis (X). In this time, the orbiting scroll (470) rotates clockwise so that the slide groove (474) is directed at the pin (465). The rotation speed of this rotation increases as the revolution angle of the orbiting scroll (470) increases from 90 degrees. When the revolution angle becomes 180 degrees, the rotation speed becomes maximum. The rotation speed decreases as the revolution angle increases from 180 degrees. When the revolution angle is substantially 270 degrees, (specifically, when the swing angle of the orbiting scroll (470) in the other direction about the pin (465) as a center is maximum), the rotation speed becomes zero. Thereafter, the rotation direction is switched. Referring to the revolution body (451), it rotates counterclockwise so that the concave (455) of the protrusion (452) is directed at the ball (453) fitted in the slide groove (454). The rotation speed of this rotation increases as the revolution angle of the revolution body (451) increases from 270 degrees. When the revolution angle becomes 360 degrees (zero degree), the rotation speed becomes maximum. The rotation speed decreases as the revolution angle increases from zero degree. When the revolution angle becomes substantially 90 degrees, (specifically, when the swing angle of the revolution body (451) in the one direction about the ball (453) as a center is maximum), the rotation speed becomes zero. Thereafter, the rotation direction is switched.

When the drive shaft (433) further rotates clockwise from the above state, as shown in FIG. 17(A), the orbiting scroll (470) revolves clockwise from the nine o'clock position to the twelve o'clock position with respect to the rotation axis (X), while the revolution body (451) revolves clockwise from the three o'clock position to the six o'clock position with respect to the rotation axis (X). In this time, the orbiting scroll (470) rotates counterclockwise so that the slide groove (474) is directed at the pin (465). The rotation speed of this rotation increases as the revolution angle of the orbiting scroll (470) increases from 270 degrees. When the revolution angle becomes 360 degrees (zero degree), the rotation speed becomes maximum. Referring to the revolution body (451), it rotates clockwise so that the concave (455) of the protrusion (452) is directed at the ball (453) fitted in the slide groove (454). The rotation speed of this rotation increases as the revolution angle of the revolution body (451) increases from 90 degrees. When the revolution angle becomes 180 degrees, the rotation speed becomes maximum.

In this way, when the orbiting scroll (470) makes one revolution about the rotation axis (X), the revolution body (451) also makes one revolution about the rotation axis (X). In this time, the revolution body (451) and the orbiting scroll (470) rotate in the reverse direction to each other, as described above. As the rotation speed of the orbiting scroll (470) increases, the rotation speed of the revolution body (451) (in the reverse direction) increases also. In reverse, as the rotation speed of the orbiting scroll (470) decreases, the rotation speed of the revolution body (451) (in the reverse direction) also decreases. As a result, rotation moment having a center at the first eccentric part (433*a*) is generated at the orbiting scroll (470), while rotation moment having a center at the second eccentric center (433*b*), which is in the reverse direction to that of the rotation moment of the orbiting scroll (470), is generated at the revolution body (451).

The rotation of the orbiting scroll (470) is limited by the pin (465), as described above, and therefore, the reaction force against the rotation moment acts on the pin (465). This reaction force acts on the compressor (401) as moment about the rotation axis (X), namely, moment caused by the reaction force. On the other hand, the rotation of the revolution body (451) is also limited by the ball (453) and the slide groove (454), so that the reaction force against the rotation moment acts on the ball (453) and the slide groove (54). This reaction force acts on the compressor (401) as moment caused by the reaction force about the rotation axis (X). Since the rotation direction of the orbiting scroll (470) is reverse to that of the revolution body (451), the direction of the reaction force against the rotation moment acting on the pin (465) is reverse about the rotation axis (X) to that of the reaction force against the rotation moment acting on the ball (453) and the slide groove (454). In other words, the moment caused by the reaction force of the orbiting scroll (470) and that of the revolution body (451) act in the directions canceling each other about the rotation axis (X).

Further, as described above, the orbiting scroll (470) is mounted at the first eccentric part (433*a*), and therefore, a load acts on the first eccentric part (433*a*) by the rotation moment of the orbiting scroll (470). This load acts on the drive shaft (433) through the first eccentric part (433*a*) as moment about the rotation axis (X), namely, moment caused by the load. On the other hand, the revolution body (451) is mounted at the second eccentric part (433*b*), and therefore, a load acts on the second eccentric part (433*b*) by the rotation moment of the revolution body (451). This load acts on the drive shaft (433) through the second eccentric part (433*b*) as moment caused by the load about the rotation axis (X). Since the rotation direction of the orbiting scroll (470) is reverse to that of the revolution body (451), the moment caused by the load of the orbiting scroll (470) and the moment caused by the load of the revolution body (451), which act on the drive shaft (433), act in the directions canceling each other about the rotation axis (X).

Thus, the moment caused by the rotation of the orbiting scroll (470) and the moment caused by the rotation of the revolution body (451) cancel each other, thereby suppressing vibration of the compressor (401).

Advantages of Example Embodiment 4

Thus, in Example Embodiment 4, the revolution body (451) are eccentric on the opposite side of the rotation axis (X) of the drive shaft (433) to the orbiting scroll (470), and the ball (453) supporting the revolution body (451) and the pin (465) supporting the orbiting scroll (470) are arranged at the same angular position about the rotation axis (X). This causes the moment caused by the rotation of the orbiting scroll (470) acting about the rotation axis (X) to be cancelled by the moment caused by the rotation of the revolution body (451) in the reverse direction, thereby reducing vibration of the compressor (401).

Other Example Embodiments

The present invention may have any of the following configurations in the above example embodiments.

Various components are employed as the movable member support part and the revolution body support part in the above example embodiments, but any of them may be replaced. For example, the pin (53) and the slide groove (54) as the revolution body support part in Example Embodiment 1 may be replaced by the ball (453), the slide groove (454), and the recess (455) as the revolution body support part in Example Embodiment 4. Alternatively, the movable member support part in Example Embodiment 4 is replaceable by any of the revolution body support parts in Example Embodiment 1 to 3.

That is, any components may be employed as the movable member support part and the revolution body support part as long as they can move the movable member and the revolution body in the back and forth direction and can rotatably support them. For example, referring to the revolution body support part in Example Embodiment 1, the pin (53) is, but is not limited to be, pressure inserted in the mounting hole of the revolution body (51). By slackly fitting the pin (53) into the mounting hole of the revolution body (51), the revolution body (51) can be rotatable about the pin (53), while the pin (53) can be freely moved back and forth in the slide groove (54). Further, in Example Embodiment 3, the notch (354) is formed in the revolution body (351) to receive the pin (535). However, this does not limit the invention, and the notch (354) may be replaced by a slide groove open at only the lower surface of the protrusion (352).

In addition, Example Embodiments 1 to 4 refer to, but are not limited to, the various compressors. Similarly to the compressors (1, 201, 301, 401), the present invention is applicable to expanders including a piston and a cylinder, either of which revolves, or a fixed scroll and a revolving orbiting scroll.

The above example embodiments are mere essentially preferable examples, and are not intended to limit any scopes of the present invention, applicable subjects, and usage.

INDUSTRIAL APPLICABILITY

As described above, the present invention is useful for rotary fluid machineries including a fixed member and a movable member forming a fluid chamber together with the fixed member.

What is claimed is:

1. A rotary fluid machinery comprising:

a fixed member;

a drive shaft driven and rotated about a predetermined rotation axis;

a movable member rotatably mounted at the drive shaft with a center of the movable member being eccentrically disposed relative to the rotation axis, with the movable member and the fixed member being arranged and configured to form a fluid chamber therebetween that changes volume in response to revolving movement of the movable member;

a movable member support part having a part engaging with the movable member to limit rotation of the movable member during revolving movement of the movable member; and a reverse moment generating mechanism including a revolution body rotatably mounted at the drive shaft with a center being eccentrically disposed relative to the rotation axis and configured to generate a moment in a reverse direction about the rotation axis relative to a moment about the rotation axis caused by the rotation of the movable member during revolving movement of the revolution body.

2. The rotary fluid machinery of claim 1, wherein the movable member support part swingably supports the movable member and movably supports the movable member in a back and forth direction along a plane along which the movable member moves during revolving movement of the movable member, the reverse moment generating mechanism includes a revolution body support part swingably supporting the revolution body and movably supporting the revolution body in a back and forth direction along a plane along which the revolution body moves during revolving movement of the revolution body, the center of the revolution body is eccentrically disposed on a same side of the rotation axis relative to the center of the movable member, and the revolution body support part is arranged at an angular position shifted by 180 degrees about the rotation axis relative to the movable member support part.

3. The rotary fluid machinery of claim 2, wherein the revolution body support part includes a pin coupled to the revolution body, and a guide part fixed to the fixed member, with the guide part being slidably and rotatably supporting the pin.

4. The rotary fluid machinery of claim 2, wherein the revolution body support part includes a pin fixed to the fixed member, and a guide part coupled to the revolution body, with the guide part being rotatable and slidable relative to the pin.

5. The rotary fluid machinery of claim 2, wherein the revolution body is constructed of a material having a specific gravity larger than a specific gravity of the movable member.

6. The rotary fluid machinery of claim 2, wherein the fixed member is a cylinder, the fluid chamber is a cylinder chamber figured in the cylinder, the movable member is a piston accommodated in the cylinder chamber with its center being eccentrically disposed with respect to the cylinder, and the movable member support part includes a blade coupled to the piston to divide the cylinder chamber into a high pressure chamber and a low pressure chamber, and a swing bush swingably supported by the cylinder and movably supporting the blade in a back and forth direction.

7. The rotary fluid machinery of claim 2, further comprising:

a cylinder including an annular cylinder chamber; and an annular piston accommodated in the cylinder chamber with its center being eccentrically disposed with respect to the cylinder to divide the cylinder chamber into an outside cylinder chamber and an inside cylinder chamber, wherein one of the cylinder and the annular piston is the fixed member, and the other of the annular piston and the fixed member is the movable member, the fluid chamber is firmed by the outside and inside cylinder chambers, and the movable member support part includes a blade coupled to the cylinder to divide each of the outside and inside cylinder chambers into a high pressure chamber and a low pressure chamber, and a swing bush swingably supported by the annular piston and movably supporting the blade in a back and forth direction.

8. The rotary fluid machinery of claim 2, wherein the fixed member is a fixed scroll, and the movable member is an orbiting scroll engaging with the fixed scroll to form the fluid chamber.

9. A rotary fluid machinery comprising:

a fixed member;

a drive shaft driven and rotated about a predetermined rotation axis;

a movable member rotatably mounted at the drive shaft with a center of the movable member being eccentrically disposed relative to the rotation axis, with the movable member and the fixed member being arranged and configured to form a fluid chamber therebetween that changes volume in response to revolving movement of the movable member;

a movable member support part having a part engaging with the movable member to limit rotation of the movable member during revolving movement of the movable member; and a reverse moment generating mechanism configured to generate a moment in a reverse direction about the rotation axis relative to a moment about the rotation axis caused by the rotation of the movable member, the movable member support part swingably supporting the movable member and movably supports the movable member in a back and forth direction along a plane along which the movable member moves during revolving movement of the movable member, the reverse moment generating mechanism including a revolution body rotatably mounted at the drive shaft with a center eccentrically disposed relative to the rotation axis, and a revolution body support part swingably supporting the revolution body and movably supporting the revolution body in a back and forth direction along a plane along which the revolution body moves during revolving movement of the revolution body, the center of the revolution body being eccentrically disposed on an opposite side of the rotation axis relative to the center of the movable member, and the revolution body support part being arranged at a same angular position about the rotation axis as the movable member support part.

10. The rotary fluid machinery of claim 9, wherein the revolution body support part includes a pin coupled to the revolution body, and a guide part fixed to the fixed member, with the guide part being slidably and rotatably supporting the pin.

11. The rotary fluid machinery of claim 9, wherein the revolution body support part includes a pin fixed to the fixed member, and a guide part coupled to the revolution body, with the guide part being rotatable and slidable relative to the pin.

12. The rotary fluid machinery of claim 9, wherein the revolution body is constructed of a material having a specific gravity larger than a specific gravity of the movable member.

13. The rotary fluid machinery of claim 9, wherein the fixed member is a cylinder, the fluid chamber is a cylinder chamber formed in the cylinder, the movable member is a piston accommodated in the cylinder chamber with its center being eccentrically disposed with respect to the cylinder, and the movable member support part includes a blade coupled to the piston to divide the cylinder chamber into a high pressure chamber and a low pressure chamber, and a swing bush swingably supported by the cylinder and movably supporting the blade in a back and forth direction.

14. The rotary fluid machinery of claim 9, further comprising:

a cylinder including an annular cylinder chamber; and an annular piston accommodated in the cylinder chamber with its center being eccentrically disposed with respect to the cylinder to divide the cylinder chamber into an outside cylinder chamber and an inside cylinder chamber, wherein one of the cylinder and the annular piston is the fixed member, and the other of the annular piston and the fixed member is the movable member, the fluid chamber is formed by the outside and inside cylinder chambers, and the movable member support part includes a blade coupled to the cylinder to divide each of the outside and inside cylinder chambers into a high pressure chamber and a low pressure chamber, and a swing bush swingably supported by the annular piston and movably supporting the blade in a back and forth direction.

15. The rotary fluid machinery of claim 9, wherein the fixed member is a fixed scroll, and the movable member is an orbiting scroll engaging with the fixed scroll to form the fluid chamber.

* * * * *